US010639514B2

(12) United States Patent
Weck

(10) Patent No.: US 10,639,514 B2
(45) Date of Patent: May 5, 2020

(54) DEVICES AND METHOD FOR INCREASING RUNNING PERFORMANCE

(71) Applicant: BOSU Fitness, LLC, San Diego, CA (US)

(72) Inventor: David S. Weck, San Diego, CA (US)

(73) Assignee: BOSU Fitness, LLC, Wilmington, DE (US)

( * ) Notice: Subject to any disclaimer, the term of this patent is extended or adjusted under 35 U.S.C. 154(b) by 58 days.

(21) Appl. No.: 15/998,709

(22) Filed: Aug. 16, 2018

(65) Prior Publication Data

US 2019/0168056 A1 Jun. 6, 2019

Related U.S. Application Data

(60) Provisional application No. 62/639,059, filed on Mar. 6, 2018, provisional application No. 62/569,702, filed on Oct. 9, 2017.

(51) Int. Cl.
*A63B 21/065* (2006.01)
*A63B 21/06* (2006.01)
(Continued)

(52) U.S. Cl.
CPC ..... *A63B 21/065* (2013.01); *A63B 21/00196* (2013.01); *A63B 21/023* (2013.01);
(Continued)

(58) Field of Classification Search
CPC ..... A63B 21/00196; A63B 21/023; A63B 21/0428; A63B 21/06; A63B 21/0603;
(Continued)

(56) References Cited

U.S. PATENT DOCUMENTS 2,509,810 A * 5/1950 Core, Jr. ..... A63B 15/00 482/108
3,334,899 A 8/1967 Bosko et al.
(Continued)

OTHER PUBLICATIONS

"Xco animation" [online] (selected frames). Jul. 27, 2015. Retrieved from the internet: <https://www.youtube.com/watch?v=fdYk0KvD1U8>, 97 pages.
(Continued)

*Primary Examiner* — Joshua Lee
(74) *Attorney, Agent, or Firm* — Lerner, David, Littenberg, Krumholz & Mentlik, LLP

(57) ABSTRACT

A running device and method of using the device are disclosed. The device may include a moveable material within an inner chamber of the running device's housing. In operation, a running device may be held in each hand and the runner may thrust both hands downward prior to landing and quickly bring the devices to a vertical stop after landing. Bringing the devices to a vertical stop may cause the moveable material to collide with the housing and increase the force exerted by the runner on the ground. A delay component may delay the peak force exerted by the material against the housing so that the translation of that force to the ground coincides with the peak force that the runner would have exerted against the ground in the absence of the devices.

20 Claims, 28 Drawing Sheets

(51) Int. Cl.

| | |
|---|---|
| ***A63B 69/00*** | (2006.01) |
| ***A63B 21/00*** | (2006.01) |
| ***A63B 21/02*** | (2006.01) |
| ***A63B 23/12*** | (2006.01) |
| ***A63B 21/072*** | (2006.01) |
| *A63B 21/04* | (2006.01) |

(52) U.S. Cl.
CPC ..... *A63B 21/06* (2013.01); *A63B 21/0603* (2013.01); *A63B 21/0607* (2013.01); *A63B 21/072* (2013.01); *A63B 21/4043* (2015.10); *A63B 23/12* (2013.01); *A63B 69/00* (2013.01); *A63B 69/0028* (2013.01); *A63B 21/0428* (2013.01); *A63B 23/1209* (2013.01); *A63B 2209/08* (2013.01); *A63B 2225/50* (2013.01)

(58) Field of Classification Search
CPC . A63B 21/0607; A63B 21/065; A63B 21/072; A63B 21/4043; A63B 23/12; A63B 23/1209; A63B 69/00; A63B 69/0028; A63B 2209/08; A63B 2225/50
See application file for complete search history.

(56) References Cited

U.S. PATENT DOCUMENTS

| | | | | |
|---|---|---|---|---|
| 4,218,057 | A | 8/1980 | Wilson | |
| 4,278,248 | A | 7/1981 | Kifferstein | |
| 4,366,956 | A * | 1/1983 | Kifferstein | A63B 69/0028 446/419 |
| 4,480,828 | A * | 11/1984 | Kifferstein | A63B 23/04 446/419 |
| 5,312,314 | A | 5/1994 | Stephan et al. | |
| 5,316,531 | A * | 5/1994 | Spence | A63B 15/00 482/106 |
| 5,979,015 | A | 11/1999 | Tamaribuchi | |
| 6,493,652 | B1 * | 12/2002 | Ohlenbusch | A61B 5/1038 324/160 |
| 8,038,585 | B1 | 10/2011 | Brown, Jr. | |
| 8,460,001 | B1 | 6/2013 | Chuang | |
| 8,573,982 | B1 * | 11/2013 | Chuang | G09B 19/0038 434/255 |
| 9,687,695 | B2 * | 6/2017 | Lee | A61B 5/6802 |
| 10,049,595 | B1 * | 8/2018 | Chuang | G09B 19/00 |
| 10,504,381 | B2 * | 12/2019 | Sato | G06K 9/00342 |
| 2004/0209680 | A1 * | 10/2004 | Oyamada | A63F 13/10 463/31 |
| 2013/0190657 | A1 * | 7/2013 | Flaction | A61B 5/1038 600/595 |
| 2016/0151657 | A1 * | 6/2016 | Kugielsky | A63B 21/072 482/93 |
| 2018/0250555 | A1 * | 9/2018 | Dean | A63B 15/00 |

OTHER PUBLICATIONS

"XCO Walking & Running . . . much more than just walking with weights (USA)" [online]. Retrieved Oct. 5, 2018. Retrieved from the internet: <https://xco-trainer.com/us/en/xco-walking-running-2>, 2 pages.
"XCO—The Training Tool" [online]. Dec. 3, 2017. Retrieved from the internet: <https://web.archive.org/web/20171203154512/xco-trainer.com/us/en/the-training-tool>, 1 page.
International Search Report & Written Opinion dates Nov. 14, 2018 for PCT/US18/00177, pp. 1-9.
Randy Moss, Vikings, running video (selected frames). 60 pages.
"Togu Hand Trainer Brasil—Europe's No. 1 for Home Fitness" [online]. Retrieved Oct. 12, 2018. Retrieved from the internet: <https://www.sport-tiedje.at/en/togu-hand-trainer-brasil-togu-470636>, 4 pages.
Military Quantitative Physiology: Problems and Concepts in Military Operational Medicine: Problems and Concepts in Military Operational Medicine (Government Printing Office, Jul. 26, 2017) [online] (selected pages). Retrieved from the internet: <https://books.google.com/books?id=h0ouDwAAQBAJ&pg=PT5868&lpg=PT586> 4 pages.
Claire Maldarelli, "Nike puts its energy-returning foam into a shoe you can train in" [online]. Popular Science, Jul. 12, 2018. Retrieved from the internet: <https://www.popsci.com/nike-pegasus-turbo-review-faster-training-runs>, 3 pages.
"XCO Studies and Expert Reports" [online]. Mar. 5, 2017. Retrieved from the internet: <http://web.archive.org/20170305103734/http://xco-trainer.com/us/en/studies-expert-reports>, 2 pages.
"Ancient Olympics" [online]. Copyright 2012. Retrieved from the internet: <http://ancientolympics.arts.kuleuven.be/eng/TC003EN.html>, 1 page.
"Deion Sanders—Atlanta Braves Highlights (pt 2)" [online] (selected frames from 1:44 to 1:48). Dec. 22, 2016. Retrieved from internet: <https://youtu.be_esk5HPQMJzE>, 59 pages.
XCO Latin Workout Shop [online]. Mar. 7, 2018. Retrieved from the Internet <http://web.archive.org/web/20180307131141/http://xcolatinworkout.com:80/Shop.html>, 3 pages.
David Weck, "Proper Running Techniques: Head-Over-Foot" [online]. Dec. 12, 2016. Retrieved from the internet: <https://www.weckmethod.com/articles/proper-running-techniques-head-over-foot>, 3 pages.
"XCO (USA)—It's what's inside that counts!" [online]. Sep. 9, 2017. Retrieved from the internet: <http://web.archive.org/web/20170909235854/http://www.xco-trainer.com:80/us/en/home>, 4 pages.
David Weck, "Double Down Pulse to Improve Running Technique" [online]. Jun. 8, 2017. Retrieved from the internet: <https://www.weckmethod.com/articles/double-down-pulse-to-improve-running-technique>, 3 pages.
"XCO-Trainer—Endurance (USA)" [online]. Dec. 3, 2017. Retrieved from the internet: <http://web.archive.org/web/20171203154204/http://xco-trainer.com:80/us/en/endurance>, 2 pages.
"Trekking pole" [online]. Jun. 11, 2018. Retrieved from the internet: <https://en.wikipedia.org/wiki/Trekking_pole>, 3 pages.
"XCO-Trainer—The XCO Effect (USA)" [online]. Dec. 3, 2017. Retrieved from the internet: <http://web.archive.org/web/20171203154217/http://xco-trainer.com:80/us/en/xco-effect>, 2 pages.
Mark Remy, "Track Stars and Floppy Necklaces: What's the Deal?" [online]. Runner's World, Feb. 22, 2011. Retrieved from the internet: <https://www.runnersworld.com/runners-stories/a20792447/track-stars-and-floppy-necklaces-whats-the-deal/>, 14 pages.
"Running Technique: 3 Hand Positions for Better Running" [online]. Aug. 28, 2015. Retrieved from the internet: <https://www.weckmethod.com/articles/running-technique-3-hand-positions-for-better-running>, 9 pages.
Serge Gracovetsky, The Spinal Engine, Oct. 2008. 4 pages.
"RMT Club Speed Training Technique: The Double Down Pulse", [online]. Retrieved Mar. 22, 2019, "created at" "Wed, Mar. 18, 2015 19:07:45 +0000". Retrieved from the internet: <https://www.pinterest.com. pin/392587292493006415/>, 26 pages.
"XCO-Trainer—Coordination (USA)" [online]. Dec. 3, 2017. Retrieved from the internet: <http://web.archive.org/web/20171203154507/http://xco-trainer.com:80/us/en/coordination>, 1 page.
"Get the RMT Club", [online]. Oct. 1, 2017. Retrieved from the internet: <https://web.archive.org/web/20171001231937/https://www.weckmethod.com/products/rmt-club-functional-training-equipment-full-body-workout-hiit>, 3 pages.
"Get the RMT Club", [online]. Nov. 9, 2016. Retrieved from the internet: <https://web.archive.org/web/20161109020756/https://www.weckmethod.com/products/rmt-club-functional-training-equipment-full-body-workout-hiit>, 2 pages.
Little Kids 2013 Catalog, cover page, p. 20 and last page.
WeckMethod, Proper Running Techniques [online]. Retrieved Oct. 5, 2018: <https.www.weckmethod.com/categories/running-techniques>, Retrieved 14 pages.
"XCO-Trainer—The XCO Effect (USA)" [online]. Retrieved Aug. 13, 2018. Retrieved from the internet: <https://xco-trainer.com/us/en/xco-effect>, 2 pages.
"XCO (USA)—It's what's inside that counts!" [online]. Retrieved Aug. 13, 2018. Retrieved from the internet: <https://xco-trainer.com/us/en/home>, 4 pages.

(56) References Cited

OTHER PUBLICATIONS

"XCO Walking & Running . . . much more than just walking with weights!" [online]. Mar. 5, 2017. Retrieved from the internet: <http://web.archive.org/web/20170305094918/http://xco-trainer.com/us/en/xco-walking-running-2>, 1 page.
"Shape your Body—Functional Training with TOGU Brasil—YouTube" [online] (selected frames). Mar. 18, 2013. Retrieved from the internet: <<https://www.youtube.com/watch?v=lsAYaVf5ak8>>, 34 pages.
"Pure fresh fresh mint—15pc pocket bottle" [online]. Sep. 2, 2017. Retrieved from internet: <http://us.mentos:80/pure-fresh-fresh-mint-15pc-pocket-bottle>, 2 pages.

* cited by examiner

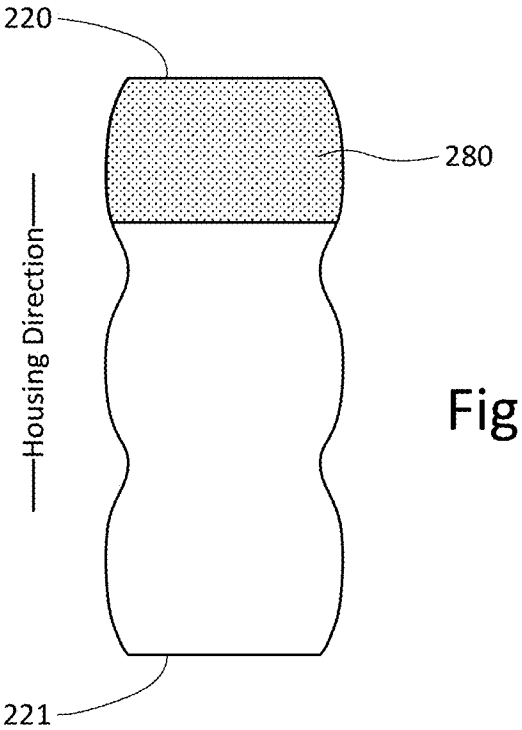
Fig. 4B
| Phase | Midflight (Transition after Left Launch) |
|---|---|
| Ground Contact | None |
| Housing Direction | Transition |
| Material Contact | Top Surface |
Fig. 4C
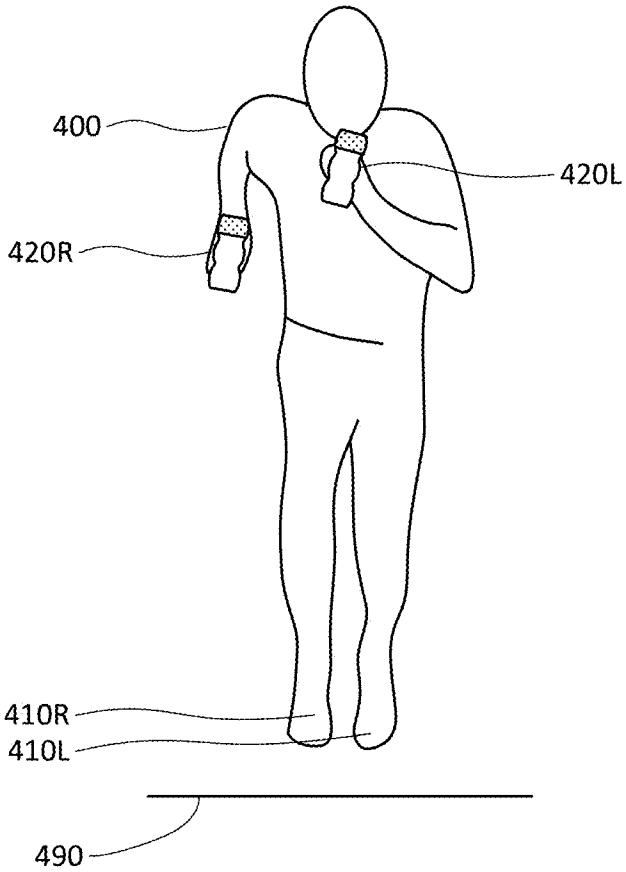
Fig. 4A

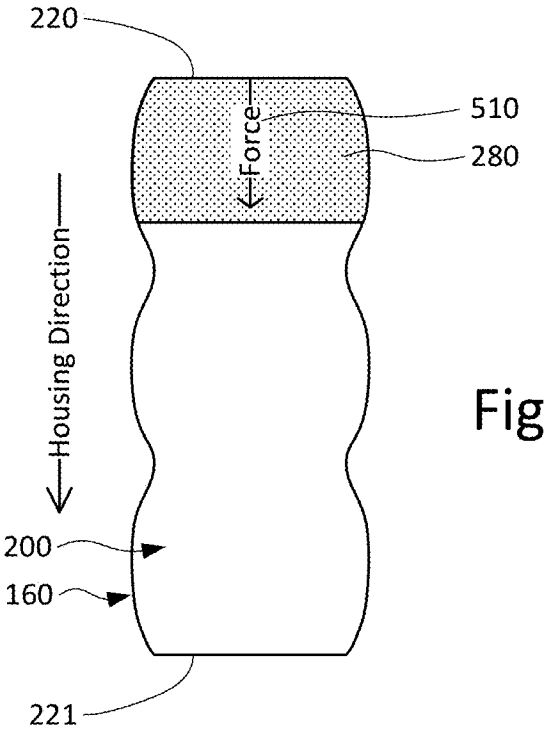
Fig. 5B
| Phase | Midflight (Before Right Land) |
|---|---|
| Ground Contact | None |
| Housing Direction | Downwards |
| Material Contact | Top Surface |
Fig. 5C
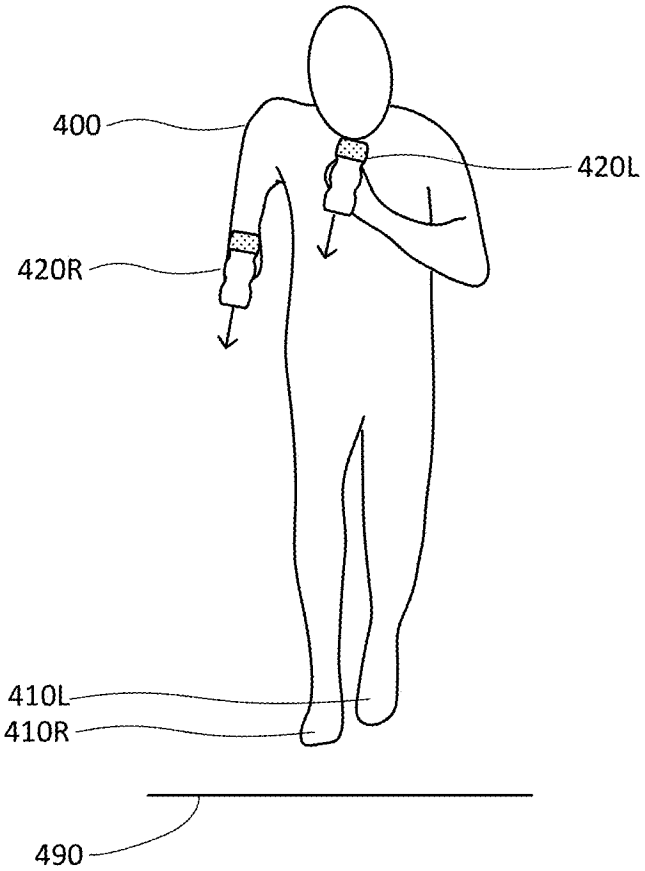
Fig. 5A

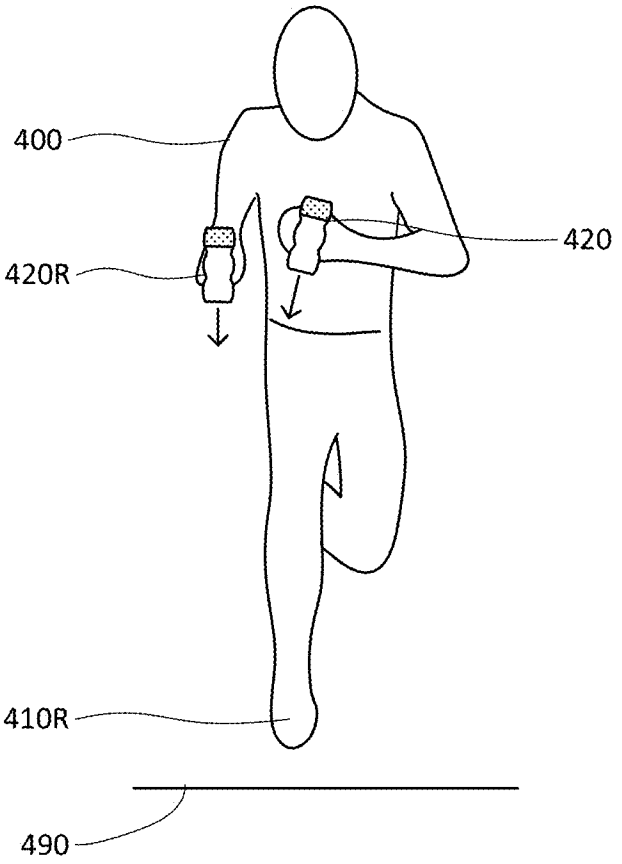
Fig. 6A
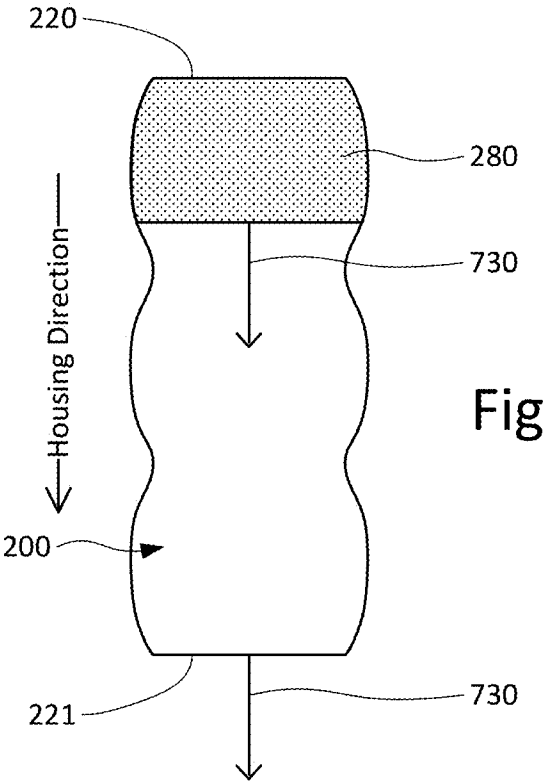
Fig. 6B
| Phase | Midflight (Before Right Land) |
|---|---|
| Ground Contact | None |
| Housing Direction | Downwards |
| Material Contact | Top Surface |
Fig. 6C

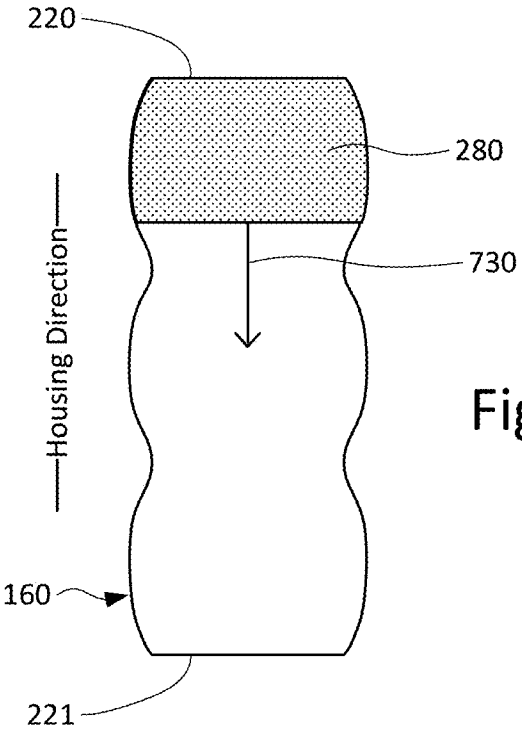
Fig. 7B
| Phase | Right Landing (Initial Contact) |
|---|---|
| Ground Contact | Right Foot |
| Housing Direction | Transition |
| Material Contact | Top Surface |
Fig. 7C
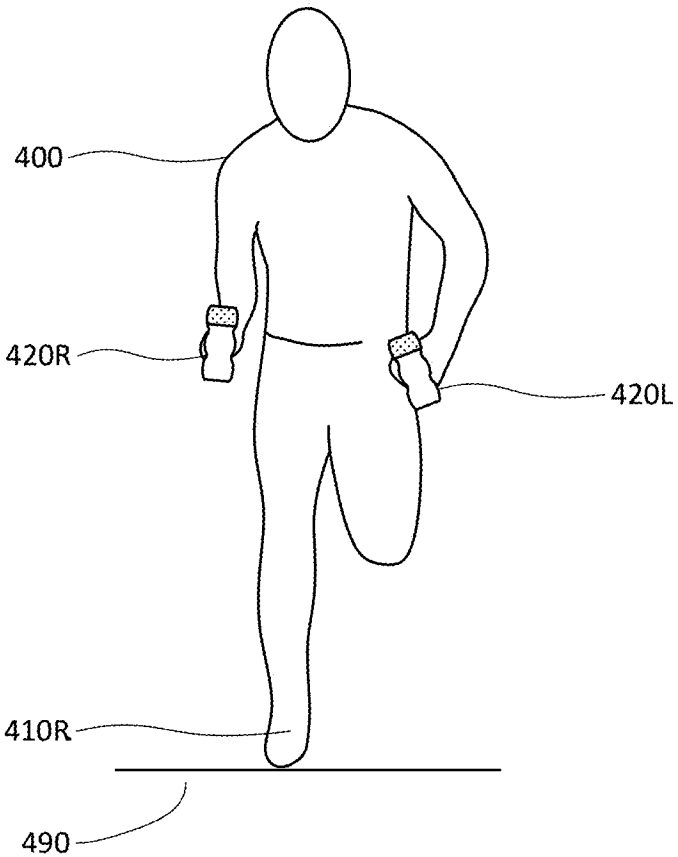
Fig. 7A

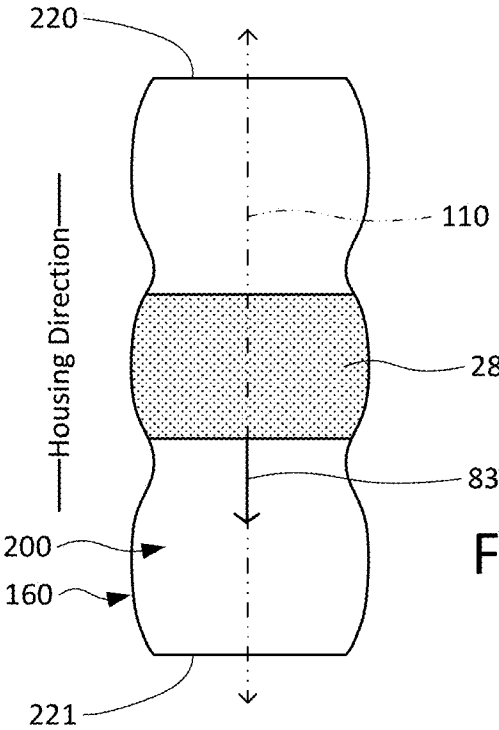
Fig. 8B
| Phase | Right Landing |
|---|---|
| Ground Contact | Right Foot |
| Housing Direction | Transition |
| Material Contact | Transition |
Fig. 8C
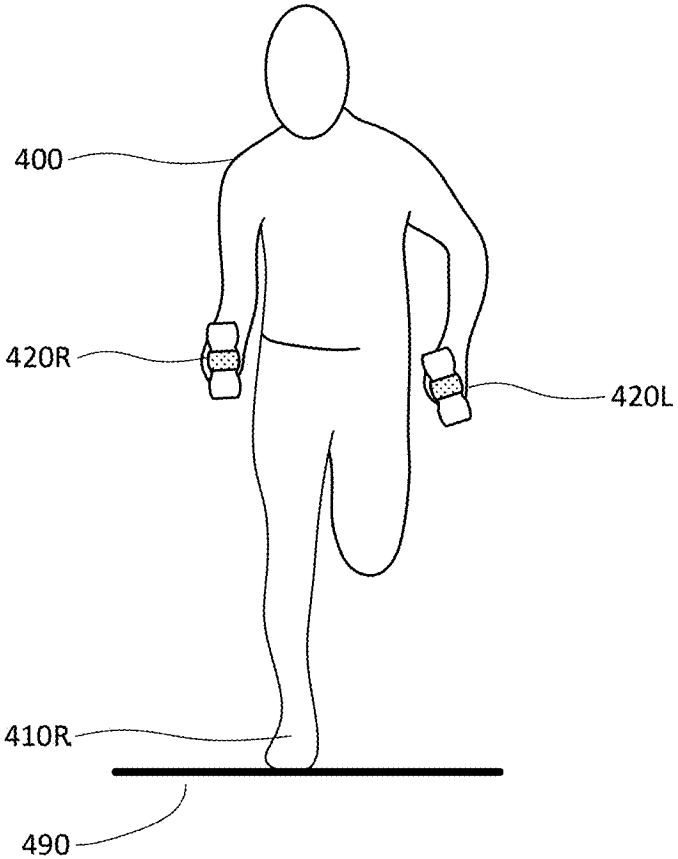
Fig. 8A

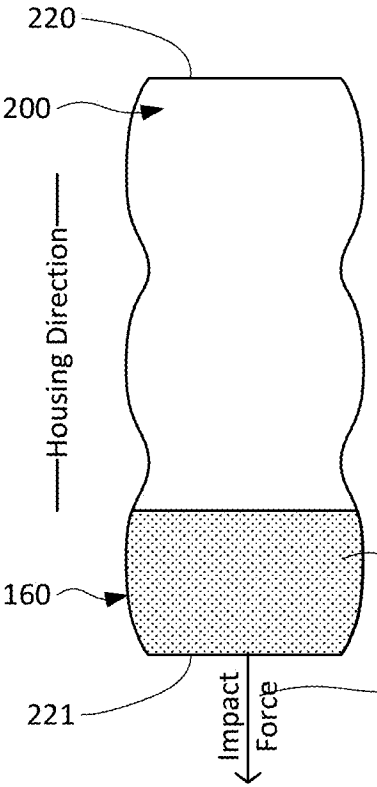
Fig. 9B
| Phase | Right Landing (Maximum Contact) |
|---|---|
| Ground Contact | Right Foot |
| Housing Direction | Transition |
| Material Contact | Bottom Surface |
Fig. 9C
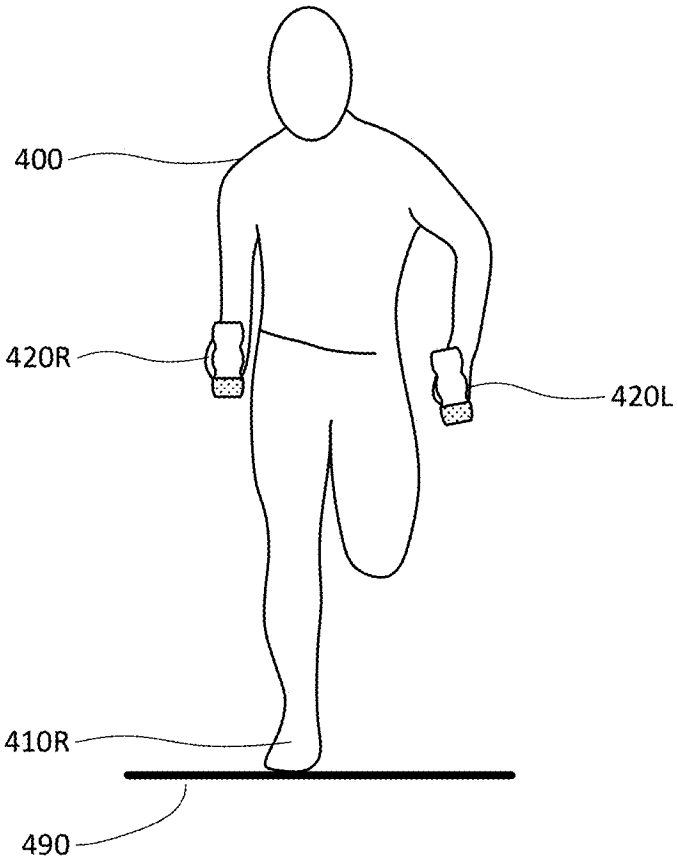
Fig. 9A

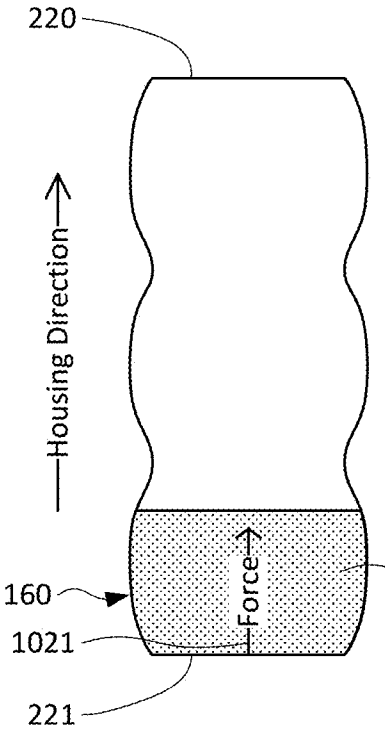
Fig. 10B
| Phase | Right Launch |
|---|---|
| Ground Contact | Right Foot |
| Housing Direction | Upward |
| Material Contact | Bottom Surface |
Fig. 10C
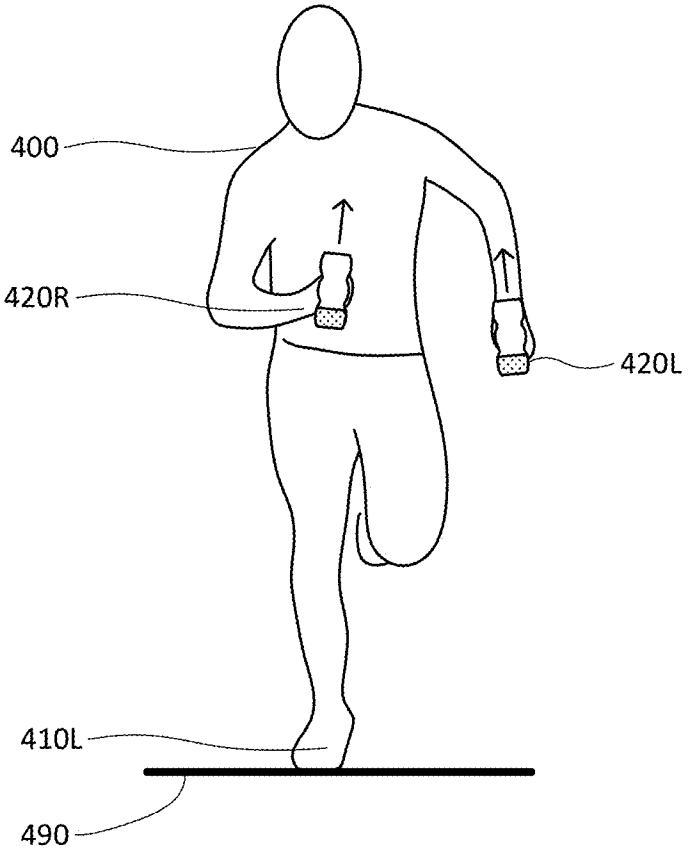
Fig. 10A

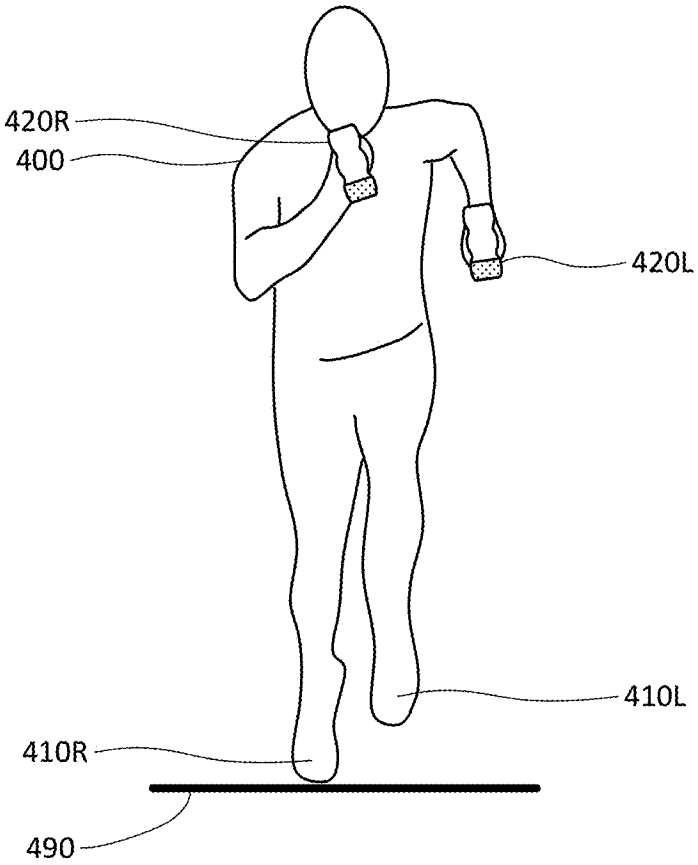
Fig. 11A
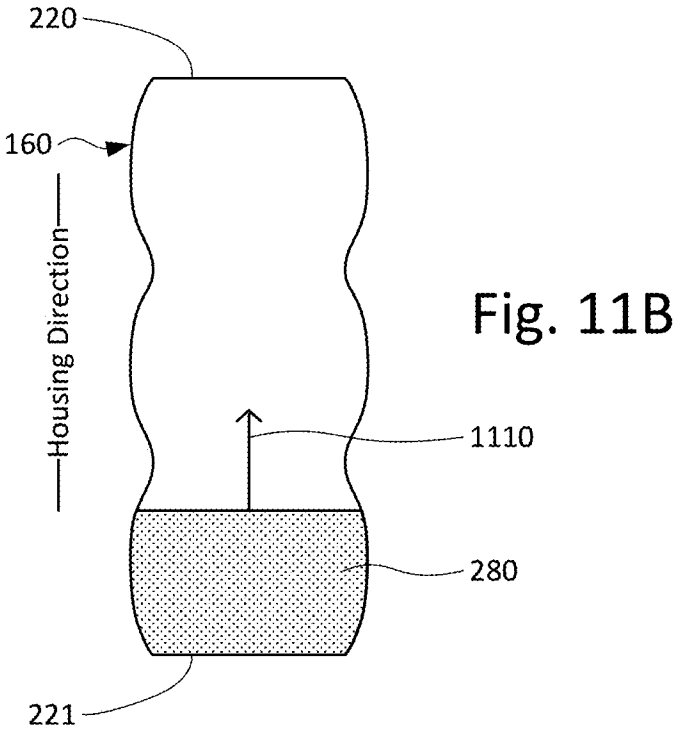
Fig. 11B
| Phase | Midflight (After Right Launch) |
|---|---|
| Ground Contact | None |
| Housing Direction | Transition |
| Material Contact | Bottom Surface |
Fig. 11C

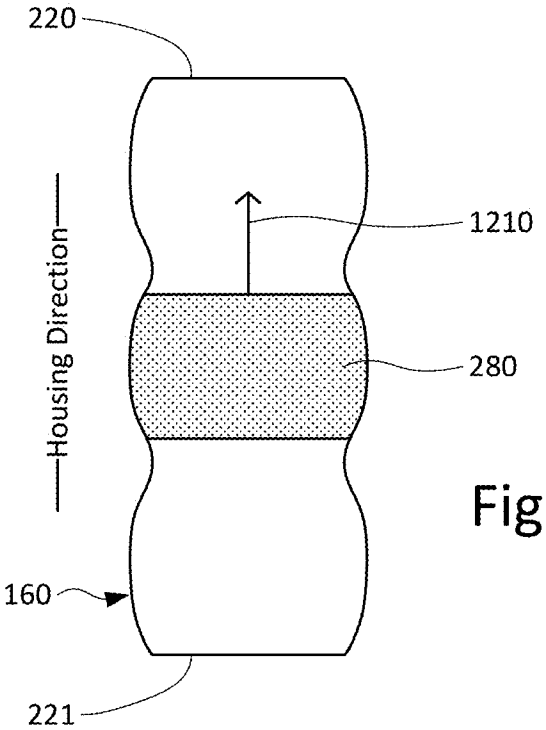
Fig. 12B
| Phase | Midflight (After Right Launch) |
|---|---|
| Ground Contact | None |
| Housing Direction | Transition |
| Material Contact | Transition |
Fig. 12C
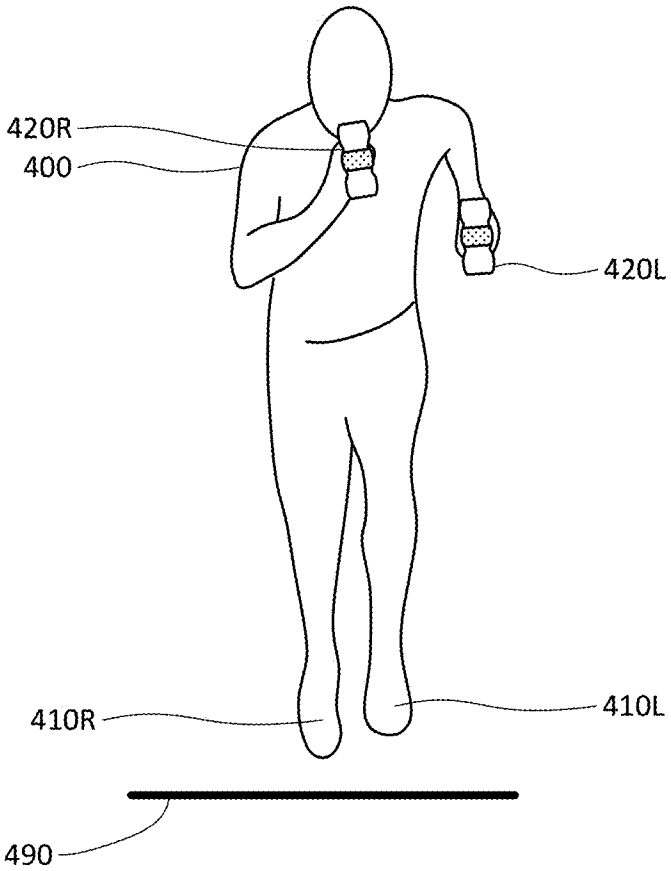
Fig. 12A

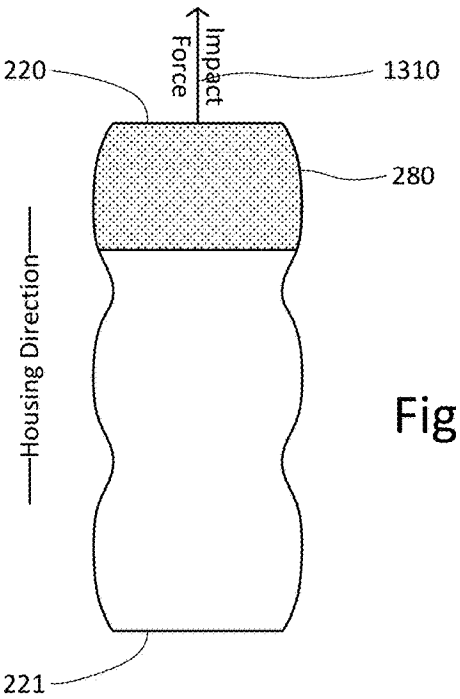
Fig. 13B
| Phase | Midflight (After Right Launch) |
|---|---|
| Ground Contact | None |
| Housing Direction | Transition |
| Material Contact | Top Surface |
Fig. 13C
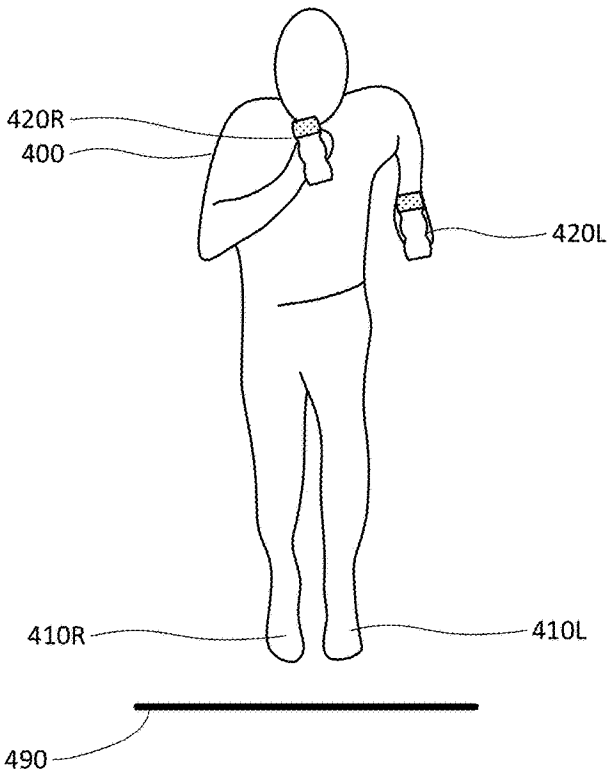
Fig. 13A

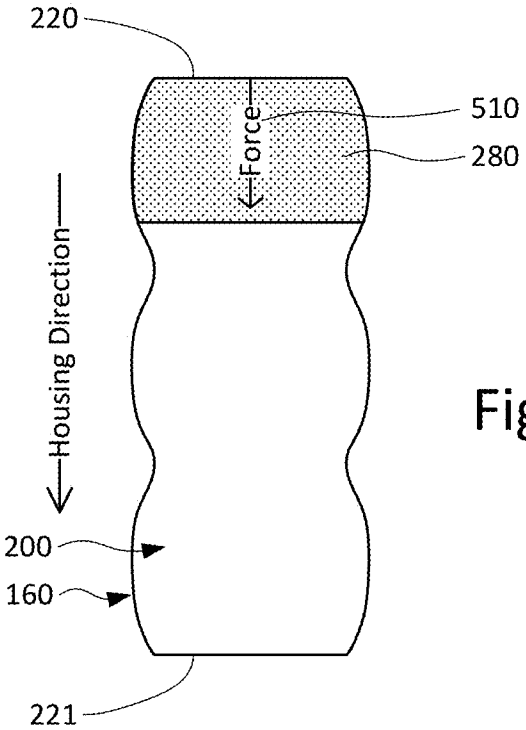
Fig. 14B
| Phase | Midflight (Transition after Right Launch) |
|---|---|
| Ground Contact | None |
| Housing Direction | Downwards |
| Material Contact | Top Surface |
Fig. 14C
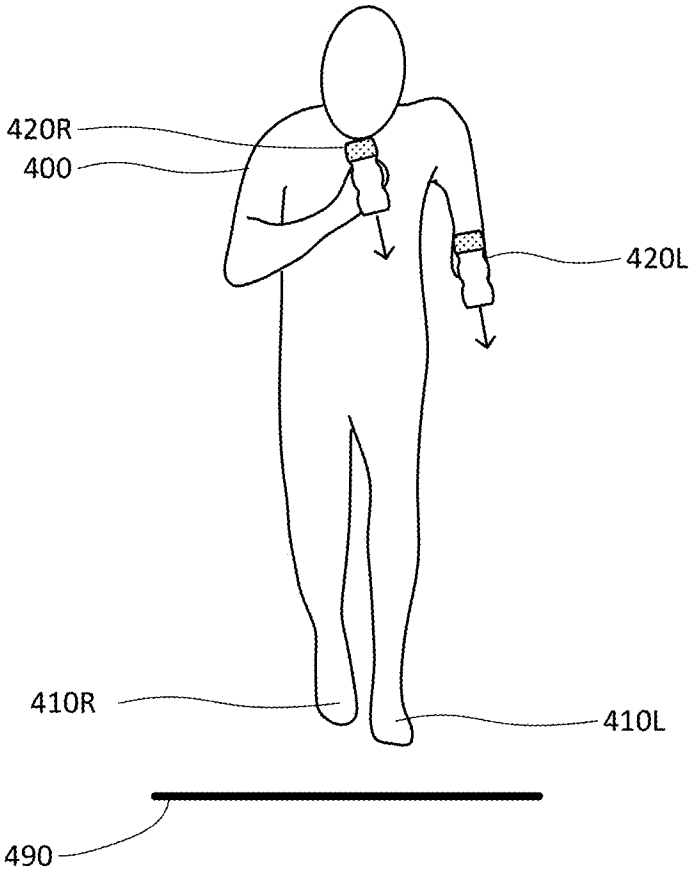
Fig. 14A

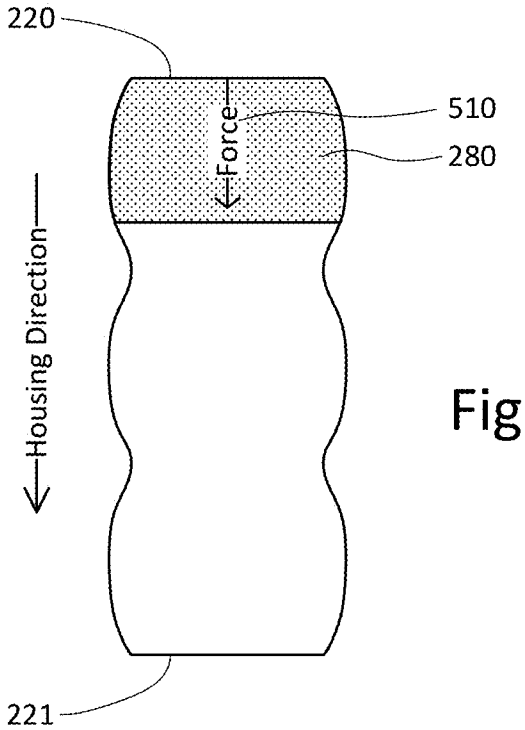
Fig. 15B
| Phase | Midflight (Before Left Land) |
|---|---|
| Ground Contact | None |
| Housing Direction | Downwards |
| Material Contact | Top Surface |
Fig. 15C
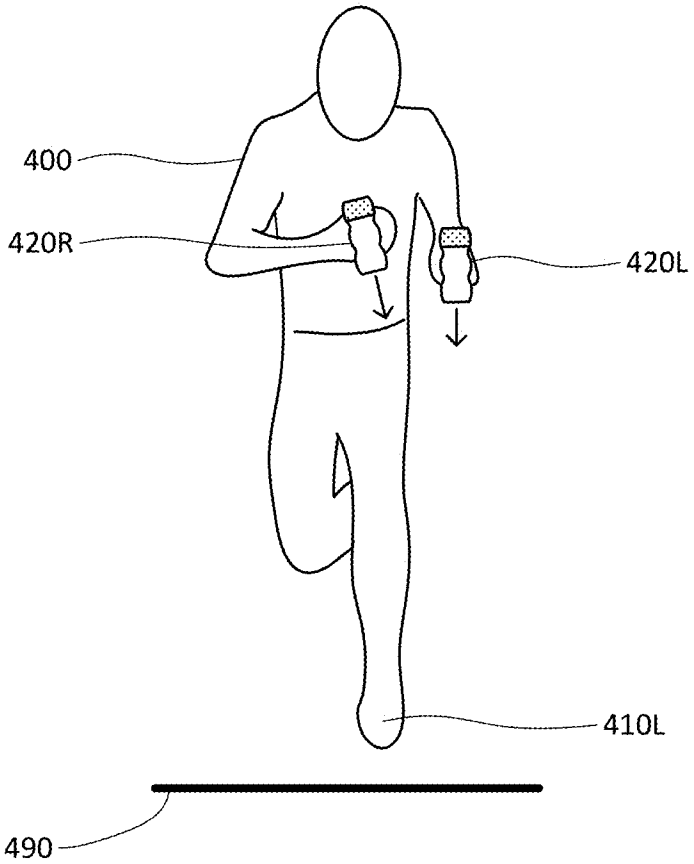
Fig. 15A

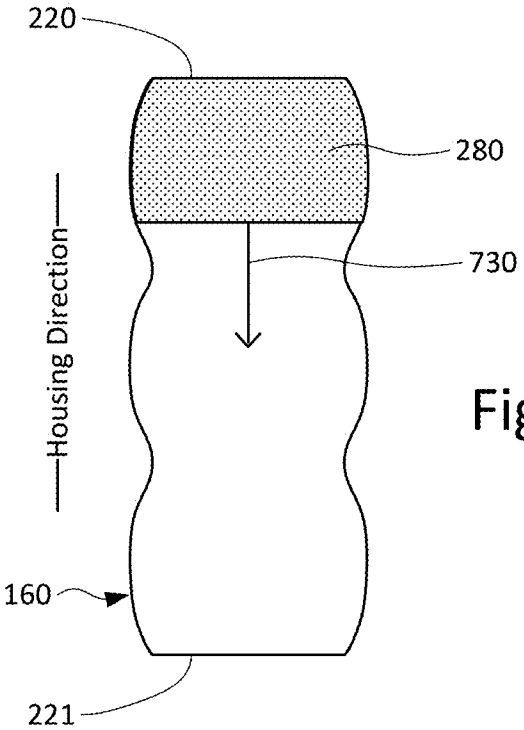
Fig. 16B
| Phase | Left Landing |
|---|---|
| Ground Contact | Left Foot |
| Housing Direction | Transition |
| Material Contact | Top Surface |
Fig. 16C
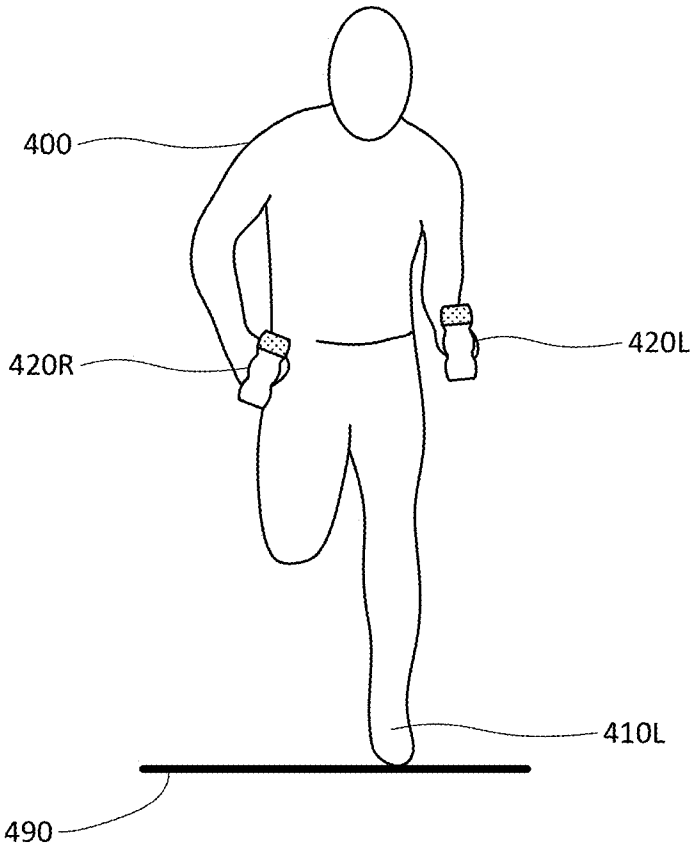
Fig. 16A

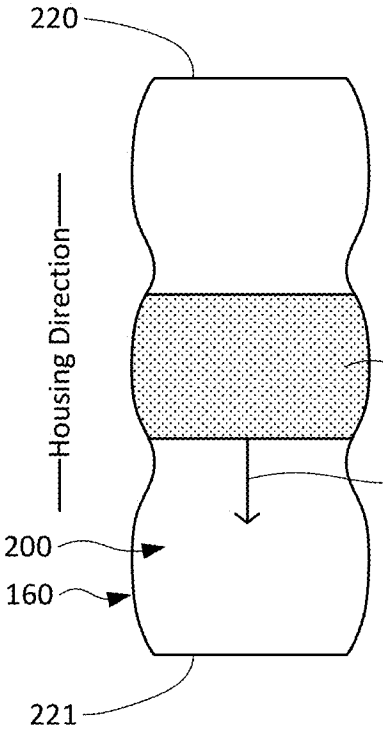
Fig. 17B
| Phase | Left Landing |
|---|---|
| Ground Contact | Left Foot |
| Housing Direction | Transition |
| Material Contact | Transition |
Fig. 17C
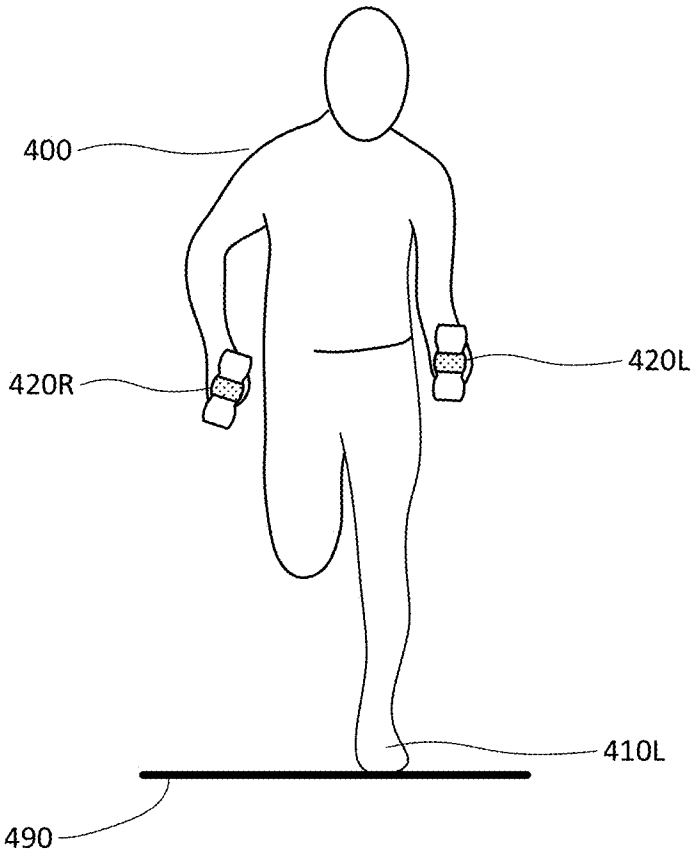
Fig. 17A

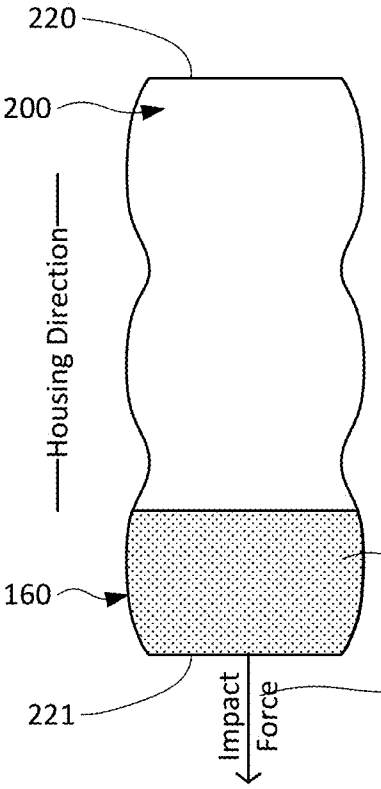
Fig. 18B
| Phase | Left Maximum Contact |
|---|---|
| Ground Contact | Left Foot |
| Housing Direction | Transition |
| Material Contact | Bottom Surface |
Fig. 18C
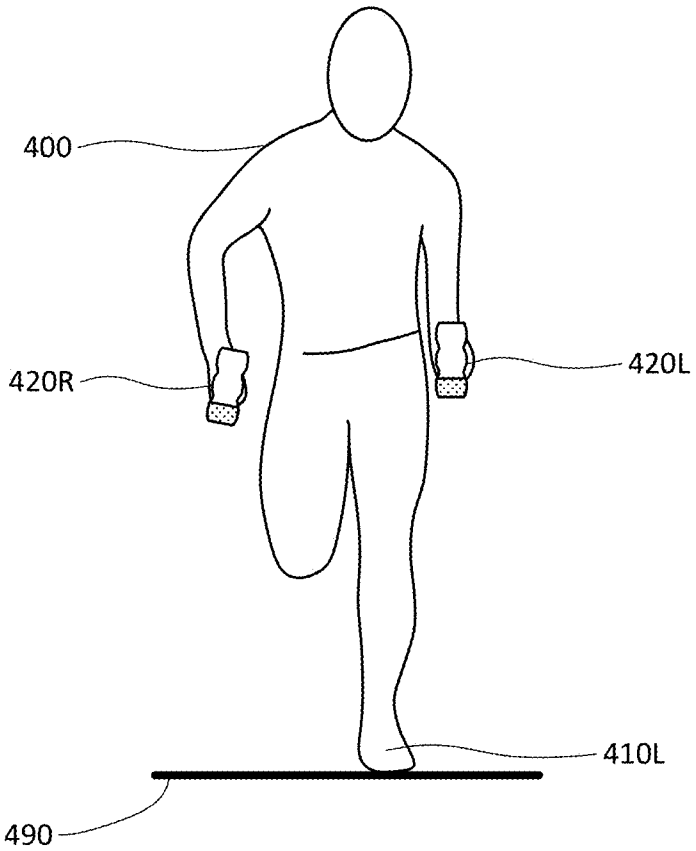
Fig. 18A

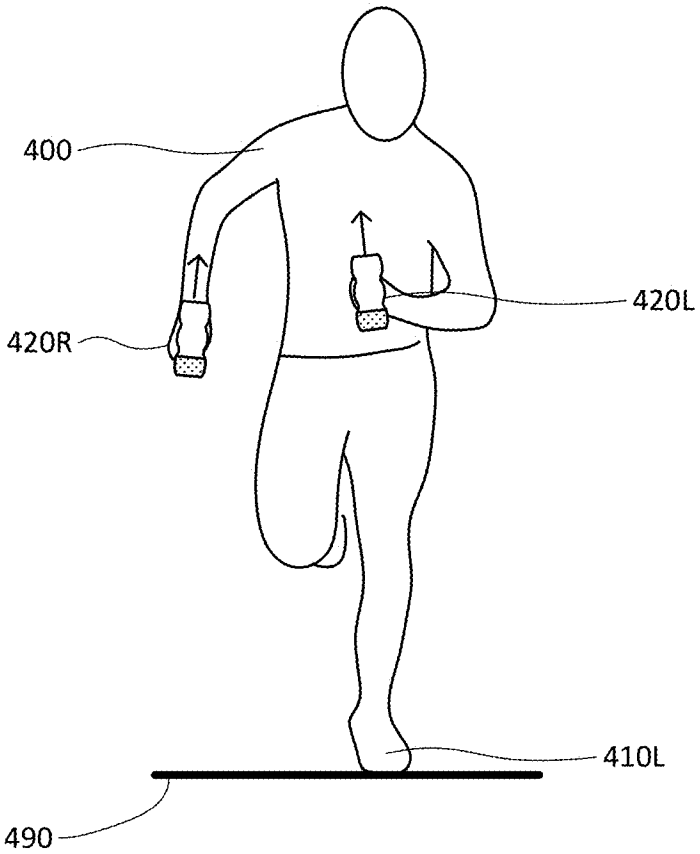
Fig. 19A
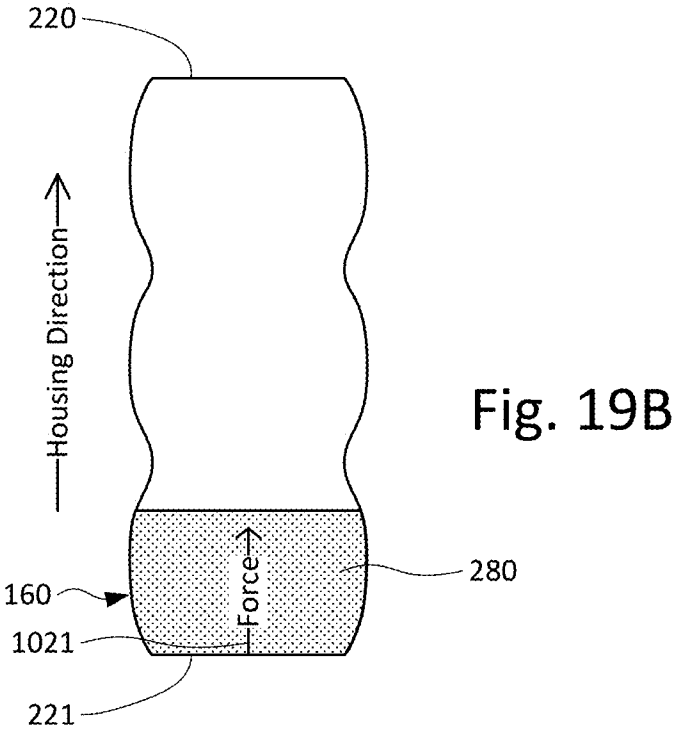
Fig. 19B
| Phase | Left Launch |
|---|---|
| Ground Contact | Left Foot |
| Housing Direction | Upward |
| Material Contact | Bottom Surface |
Fig. 19C

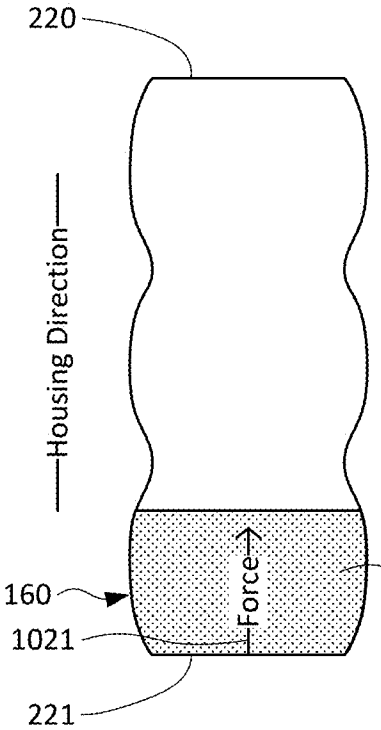
Fig. 20B
| Phase | Midflight (After Left Launch) |
|---|---|
| Ground Contact | None |
| Housing Direction | Transition |
| Material Contact | Bottom Surface |
Fig. 20C
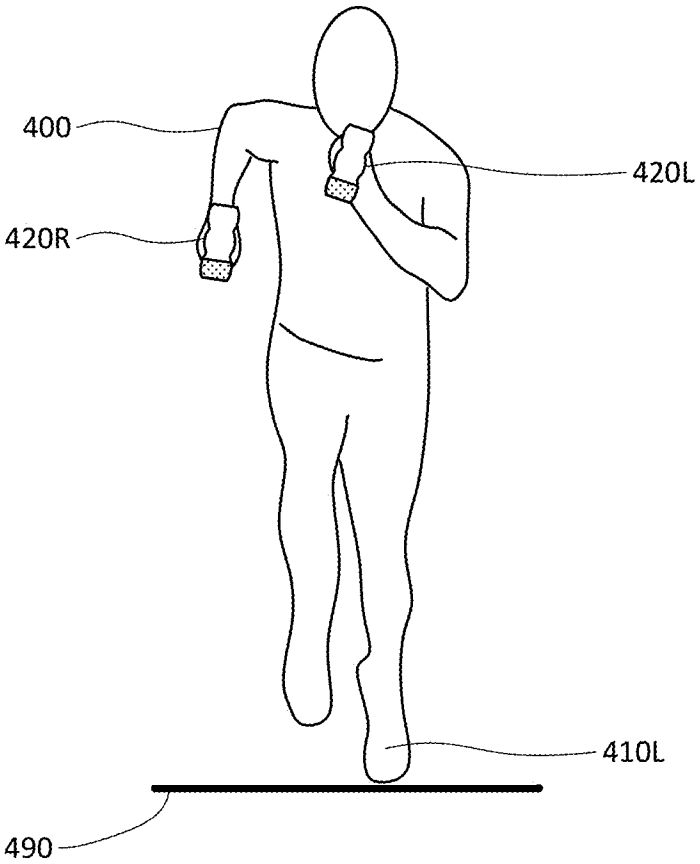
Fig. 20A

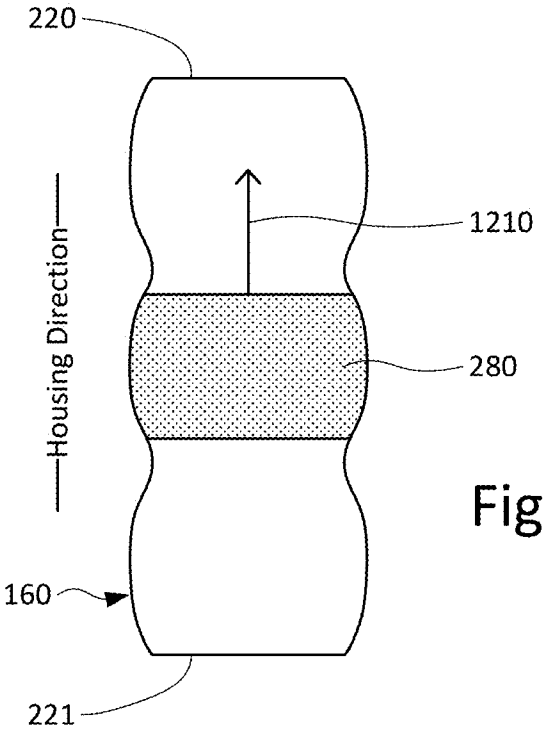
Fig. 21B
| Phase | Midflight (After Left Launch) |
|---|---|
| Ground Contact | None |
| Housing Direction | Transition |
| Material Contact | Transition |
Fig. 21C
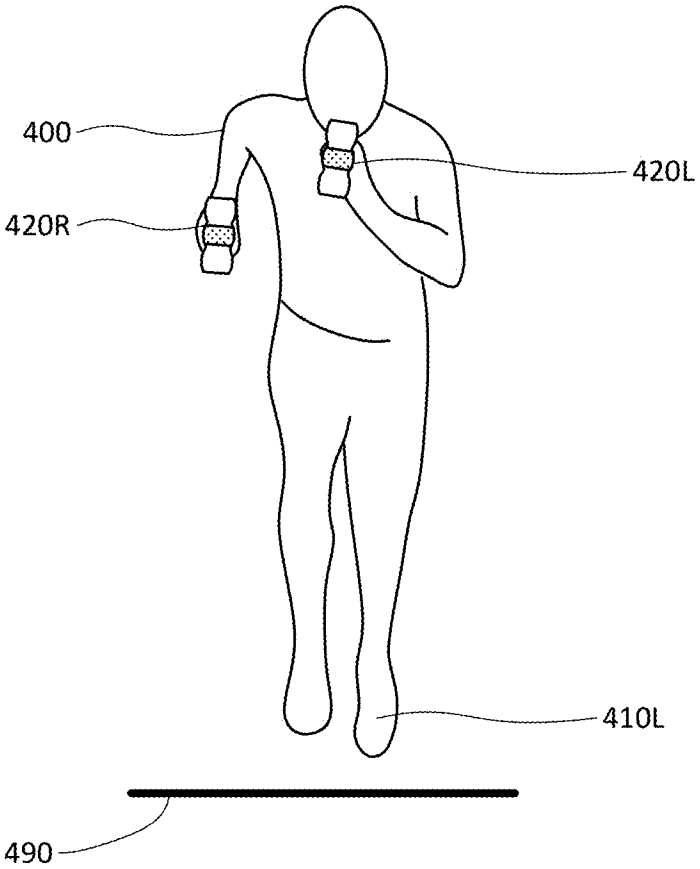
Fig. 21A

DEVICES AND METHOD FOR INCREASING RUNNING PERFORMANCE

CROSS-REFERENCE TO RELATED APPLICATIONS

The present application claims the benefit of the filing date of U.S. Provisional Patent Application Nos. 62/569,702 and 62/639,059 filed Oct. 9, 2017 and Mar. 6, 2018, the disclosures of which are hereby incorporated herein by reference.

BACKGROUND OF THE INVENTION

One of the most well-known styles of running is to swing your arms and hands forwards and backwards to match the forwards and backwards motion of the opposite leg and foot (hereafter, the "swinging arms technique"). By way of example, FIG. 26 illustrates one cycle of a swinging arms technique. Frames (c) through (e) show the runner's center of mass continuing forward as the runner's left foot remains planted on the ground. As the left foot moves behind the runner, the runner's right hand moves behind the runner as well. Indeed, when the runner's left foot is in maximum contact with the ground as shown in frame (d), the vast majority of the momentum in the runner's right hand is moving backwards and parallel to the ground. When performing the swinging arms technique, the runner's hands also tend to move in opposite vertical directions while one of the runner's feet is on the ground. For example, as the runner moves from the position shown in frame (c) to the position shown in frame (d), the runner's left hand moves down (and backwards) and the runner's right hand moves up (and forwards). As a result, when using the swinging arms technique, one hand is typically moving primarily backwards and the other hand is moving primarily upwards at the moment a foot is in maximum contact with the ground.

It has been proposed that running with hand-held, wrist or leg weights while using the swinging arm technique will help a person intensify the effort of running for the purposes of burning more calories and increasing one's endurance. However, at least some experts in the field of sprinting believe that training to run faster by carrying weights while using the swinging arm technique is counter-productive because carrying the weights interferes with the coordination and timing to maintain the necessary stride frequencies to sprint fastest when the weights are not carried. Regardless of whether training with weights results in positive or negative results, people tend to run slower when they hold weights in their hand or wear them on their wrist while performing the swinging arms technique.

It has been advertised that certain products can help a runner perform better if they use the product while running. For instance, at least some have asserted that a person can run faster and more efficiently if they wear certain types of athletic footwear than no footwear at all. By way of example, spiked track and field shoes typically have rigid foot beds and spikes to create better traction and rebound off the ground.

BRIEF SUMMARY OF THE INVENTION

In one aspect, a method of using a first running device and a second running device is provided, wherein the first running device is gripped by or removably affixed to the left hand and the second running device is gripped by or removably affixed to the right hand. Each running device may include a closed inner chamber defined at least in part by a top inner surface and a bottom inner surface facing the chamber, the top inner surface and the bottom inner surface further defining a longitudinal axis extending from the top inner surface to the bottom inner surface. Each running device may also include a moveable material disposed within the closed inner chamber and configured to provide a gap between the moveable material and the top surface when the moveable material is in contact with the bottom surface and to provide a gap between the moveable material and the bottom surface when the moveable material is in contact with the top surface. Each running device may further include a housing containing the closed inner chamber and the moveable material, and configured to be gripped by or removably affixed to a hand. The method may include: as the left foot is launching, raising both running devices such that the moveable material in the first running device is pushed against the bottom surface of the inner chamber of the first running device and the moveable material in the second running device is pushed against the bottom surface of the inner chamber of the second first running device; when both feet are off the ground, lowering both running devices, such that the moveable material in the first running device changes from being pushed against the bottom surface to being pushed downward by the top surface of the first running device and the moveable material in the second running device changes from being pushed against the bottom surface to being pushed downward by the top surface of the second running device, (c) when the right foot is in contact with the ground, decelerating both running devices, such that the moveable material in the first running device collides with the bottom surface of the inner chamber of the first running device when the right foot is in contact with the ground and the moveable material in the second running device collides with the bottom surface of the inner chamber of the second running device when the right foot is in contact with the ground, and (d) as the right foot is leaving the ground, raising both running devices such that the moveable material in the first running device is pushed against the bottom surface of the inner chamber of the first running device and the moveable material in the second running device is pushed against the bottom surface of the inner chamber of the second first running device.

In another aspect, a method of using a first running device and a second running device is provided, wherein the first running device being gripped by the left hand and the second running device being gripped by the right hand. Each running device may include a housing having a generally cylindrical outer surface and generally cylindrical inner side surface, an inner top surface, an inner bottom surface, the housing, inner top surface and inner bottom surface defining an inner chamber, a protrusion extending from the inner side surface into the inner chamber, and loose material disposed within the inner chamber. The method may include: before the left foot launches from the ground, accelerating the upwards vertical velocity of each running device such that the loose material in each running device is pushed against the inner bottom surface of the inner chamber; after the left foot has left the ground and before the right foot makes initial contact, accelerating the downwards vertical velocity of each running device such that the loose material in each running device is pushed against the inner top surface of each running device; after the right foot makes initial contact with the ground, decelerating the downwards vertical velocity of each running device such that the loose material in each device collides with the inner bottom surface of the inner chamber; before the right foot launches from the ground and after decelerating the downwards vertical velocity of each running device, accelerating the upwards vertical velocity of each running device such that the loose material in each running device is pushed against the inner bottom surface of the inner chamber, and after the right foot has left the ground and before the left foot makes initial contact, accelerating the downwards vertical velocity of each running device such that the loose material in each running device is pushed against the inner top surface of each running device.

In yet another aspect, a method of using a left running device held in the left hand and right running device held in the right hand is provided, wherein each running device includes a housing having a generally cylindrical outer surface and generally cylindrical inner side surface, an inner top surface, an inner bottom surface, the housing, inner top surface and inner bottom surface defining an inner chamber, a plurality of protrusions extending from the inner side surface into the inner chamber, and pellets disposed within the chamber. The method may include: before the left foot launches from the ground, accelerating the upwards vertical velocity of each running device such that the pellets in each running device are pushed against the inner bottom surface of the inner chamber; after the left foot has left the ground and before the right foot makes initial contact, accelerating the downwards vertical velocity of each running device such that the pellets in each running device are pushed against the inner top surface of each running device; after the right foot makes initial contact with the ground, decelerating the downwards vertical velocity of each running device such that the pellets in each device collides with the inner bottom surface of the inner chamber; before the right foot launches from the ground and after decelerating the downwards vertical velocity of each running device, accelerating the upwards vertical velocity of each running device such that the pellets in each running device are pushed against the inner bottom surface of the inner chamber; and after the right foot has left the ground and before the left foot makes initial contact, accelerating the downwards vertical velocity of each running device such that the pellets in each running device are pushed against the inner top surface of each running device.

BRIEF DESCRIPTION OF THE DRAWINGS

FIGS. 4A-4C are, collectively, a diagram of a method of using the example of the running device. FIG. 4A illustrates, at a moment in time during a running cycle, the position of a person's body when running with a running device, FIG. 4B illustrates the relative position of a material in the chamber of the device at that moment, and FIG. 4C is a chart listing the phase of the running cycle, the runner's state of contact with the ground, the primary direction in which the device's housing is moving, and the position of the material within the chamber, at that moment.

FIGS. 5A-5C are, collectively and similar to FIGS. 4A-4C, a diagram of a method of using the example of the running device, but at a different moment in time during the running cycle.

FIGS. 6A-6C are, collectively and similar to FIGS. 4A-4C, a diagram of a method of using the example of the running device, but at a different moment in time during the running cycle.

FIGS. 7A-7C are, collectively and similar to FIGS. 4A-4C, a diagram of a method of using the example of the running device, but at a different moment in time during the running cycle.

FIGS. 8A-8C are, collectively and similar to FIGS. 4A-4C, a diagram of a method of using the example of the running device, but at a different moment in time during the running cycle.

FIGS. 9A-9C are, collectively and similar to FIGS. 4A-4C, a diagram of a method of using the example of the running device, but at a different moment in time during the running cycle.

FIGS. 10A-10C are, collectively and similar to FIGS. 4A-4C, a diagram of a method of using the example of the running device, but at a different moment in time during the running cycle.

FIGS. 11A-11C are, collectively and similar to FIGS. 4A-4C, a diagram of a method of using the example of the running device, but at a different moment in time during the running cycle.

FIGS. 12A-12C are, collectively and similar to FIGS. 4A-4C, a diagram of a method of using the example of the running device, but at a different moment in time during the running cycle.

FIGS. 13A-13C are, collectively and similar to FIGS. 4A-4C, a diagram of a method of using the example of the running device, but at a different moment in time during the running cycle.

FIGS. 14A-14C are, collectively and similar to FIGS. 4A-4C, a diagram of a method of using the example of the running device, but at a different moment in time during the running cycle.

FIGS. 15A-15C are, collectively and similar to FIGS. 4A-4C, a diagram of a method of using the example of the running device, but at a different moment in time during the running cycle.

FIGS. 16A-16C are, collectively and similar to FIGS. 4A-4C, a diagram of a method of using the example of the running device, but at a different moment in time during the running cycle.

FIGS. 17A-17C are, collectively and similar to FIGS. 4A-C, a diagram of a method of using the example of the running device, but at a different moment in time during the running cycle.

FIGS. 18A-18C are, collectively and similar to FIGS. 4A-4C, a diagram of a method of using the example of the running device, but at a different moment in time during the running cycle.

FIGS. 19A-19C are, collectively and similar to FIGS. 4A-4C, a diagram of a method of using the example of the running device, but at a different moment in time during the running cycle.

FIGS. 20A-20C are, collectively and similar to FIGS. 4A-4C, a diagram of a method of using the example of the running device, but at a different moment in time during the running cycle.

FIGS. 21A-21C are, collectively and similar to FIGS. 4A-4C, a diagram of a method of using the example of the running device, but at a different moment in time during the running cycle.

DETAILED DESCRIPTION

Overview

A system and method is provided for improving a runner's performance.

By way of example only, substantially identical devices may be held in each hand while running, wherein each device has an inner chamber that includes a moveable material and a delay component. While running, both devices (e.g., both the device in the left hand and the device in the right hand) may be thrust upwards as one foot is launching off of the ground and, before the next foot lands, both devices may be thrust downwards.

If the devices are so configured, this may cause the material to be thrust upwards as and after the runner's feet leave the ground and, while the runner is in midflight, cause the material to be thrust downwards before the runner's feet contact the ground.

Immediately after the left or right foot landing on the ground, the runner may bring both devices to an abrupt stop relative to the ground plane, which may have the effect of propelling the still-moving material inside the chamber towards the now stationary surface of the chamber. Rather than allowing the material to proceed to the bottom surface of the chamber unimpeded, the delay component within the chamber may delay the collision of the material with the bottom surface until a moment shortly before the left or right foot (as the case may be) reaches maximum impact with the ground. The delay component may also distribute the force of the collision over a greater period of time than may occur in the absence of the component.

While the invention is not limited to any theory of operation, it is believed that delaying and distributing the impact until and over a span of time shortly before the left or right foot reaches maximum ground impact causes the fascia (the interconnected sheaths of fibrous tissue enclosing muscles and other organs) to rapidly tense just prior to maximum ground impact. Since the fascia is tensed shortly before maximum ground impact, it is further believed the method increases the recoil effect of the fascia and reduces the load on the muscles relative to running without the use of the devices.

Regardless of the theory of operation, athletes have been observed in time trials to run faster holding the devices and running as described above than those same athletes normally run in the absence of the devices and/or running by swinging their left hand and right hand forwards and backwards in opposition to their right foot and left foot, respectively.

Example Systems and Methods

One example of such a device and a method of using it is illustrated in FIGS. 1-21.

Figure 3:
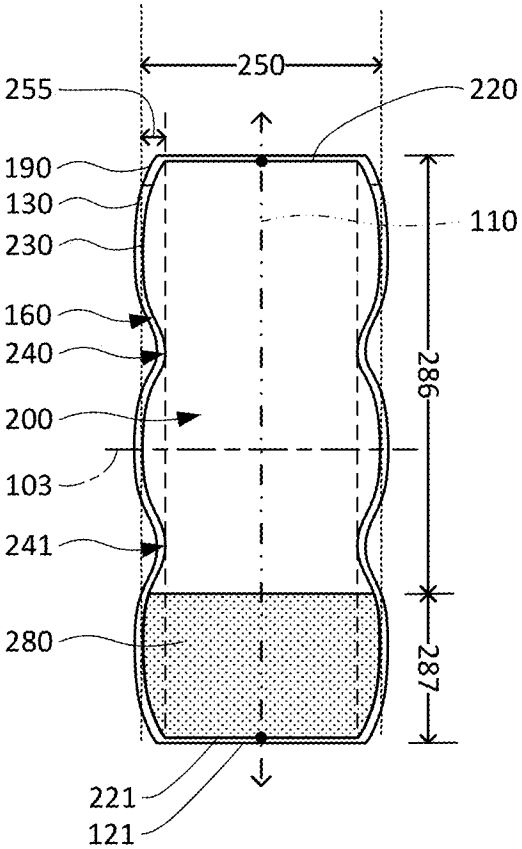
FIG. 3 is a side cross-sectional side view of the example of the running device.
Figure 2:
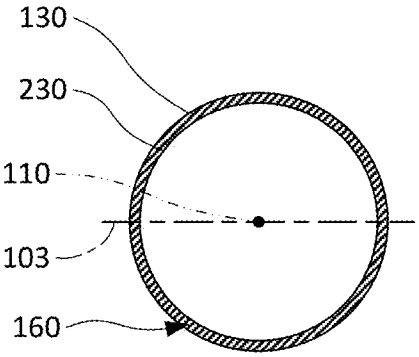
FIG. 2 is a top-down cross-sectional side view of the example of the running device.
Figure 1:
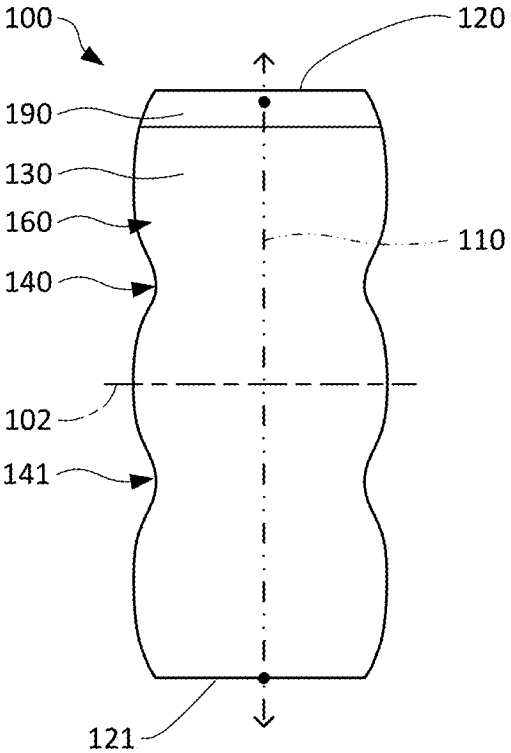
FIG. 1 is an outer side view of one example of a running device.

As shown in FIGS. 1-3, running device 100 may include a housing 160 that defines an inner chamber 200, within with a material 280 is moveably disposed. As explained in more detail below, running device 100 may also include a delay component. FIG. 1 is an outer side view of device 100, FIG. 2 is a cross-sectional top-down view of device 100 relative to plane 102, and FIG. 3 is a cross-sectional side view of device relative to plane 103.

The running device may be sized and shaped to be comfortably and securely gripped by one hand. For instance, the outer surface of housing 160 of device 100 may be shaped so as to be longer along one axis of direction than the other axes, e.g., outer side surface 130 of housing 160 may be generally cylindrical relative to longitudinal axis 110. The outer surface of the housing 160 may include at either end an outer top surface 120 or an outer bottom surface 121, which are opposed to each other and generally perpendicular to longitudinal axis 110. During use, the runner may grip running device 100 so that the majority of the outer side surface 130 remains in contact with the runner's palm and fingers. Outer top surface 120 may also be configured and sized so the runner may comfortably rest his or her index finger relatively higher than the thumb and other fingers along or near the top of the device while running.

Although the running devices disclosed herein are not limited to specific sizes, certain absolute and relative sizes are believed to be and have been observed to increase a runner's performance. In that regard, the ratio of the height of the outer surface of the housing (e.g., the distance from outer top surface 120 to outer bottom surface 121 along longitudinal axis 110) relative to the widest portion of the outer side surface 130 may range from 3:1 to 1.65:1. The height and width of the outer surface of the housing for an adult-sized version of the device may range from 30 to 60 millimeters and from 30 to 60 millimeters wide. Other embodiments of the device may have different shapes.

The outer surface of the device may also be contoured to help a user maintain a firm grip on the device while running. By way of example, outer side surface 130 of housing 160 may contain two indentations 140 and 141 such that the outer width of the device is smaller at the indentations than other portions of the outer surface. In that regard, the width of outer side surface 130 at indentations 140 and 141 may be smaller than the maximum width of the outer side surface between outer top surface 120 and indentation 140, smaller than the maximum width of outer side surface 130 between indentation 140 and indentation 141, and the maximum width of the portion between indentation 141 and outer bottom surface 121. Outer top surface 120 may also include a groove for the runner's index finger (not shown). Other aspects of the device may include a greater or lesser number of indentations.

When device 100 is sized in the ranges described above, the ratio of the width of outer side surface 130 at indentations 140 and 141 relative to the maximum width of the outer surface of the housing between indentation 140 and indentation 141 may range from 1.1:1 to 1.35:1. As discussed in more detail below, indentations 140 and 141 may be further shaped to correspond with a delay component, in which case the shape and size of indentations 140 and 141 may be selected to promote not only good comfort and grip for a person, but also their properties as a delay component.

As noted above, device 100 includes a chamber 200 defined by housing 160. For instance, chamber 200 is defined by inner side surface 230, inner top surface 220, and inner bottom surface 221 of housing 160. Inner side surface 230, inner top surface 220 and inner bottom surface 221 oppose outer side surface 130, outer top surface 120 and outer bottom surface 121, respectively.

Running device 100 may include protrusions 240 and 241 that extend into chamber 200 from inner side surface 230 and form part of a delay component. Although the running device is not limited to specific sizes, the ratio of the distance 255 that protrusions 240 and 241 extend into chamber 200 relative to maximum width 250 of chamber 200 may range from 1.1:1 to 1.35:1. The maximum width 250 of chamber 200 in an adult-sized version of the device may range from 90 to 150 millimeters. In addition to different sizes, other aspects of the device may include a greater or lesser number of protrusions.

The chamber of the running device may include a material that is capable of movement within the chamber. Although the moveable material is shown in FIG. 3 and other figures as a single unit of moveable material 280, material 280 may be composed of many loose pellets capable of movement within the chamber. By way of example, each individual pellet may be made of steel, substantially spherically shaped, and range from 1.5 to 5.75 millimeters in diameter.

The moveable material may be configured to make contact with one of the surface of the chamber. In that regard, in order to provide material 280 with room to move into and out of contact with the inner bottom surface 221, device 100 may provide for a gap 286 between material 280 and inner top surface 220 when material 280 is at rest and in contact with bottom surface 221. The ratio of the height of gap 286 relative to the height 287 of material 280 may range from 3.1 to 0.67:1.

The running devices disclosed herein may permit a user to access the device's chamber and moveable material. By way of example, running device 100 may include a cap 190 that can be attached and detached from housing 160. When detached, a user may inspect, add, or remove all or portions of material 280.

Although running device 100 is described and shown as having symmetrical "top" and "bottom" outer and inner surfaces, a runner may decide which portion of the device to use as the "top" (e.g., by changing the orientation of the device relative to the direction of gravity). For instance, the width of inner top surface 220 may be narrower or wider than the width of inner bottom surface 221 and some users may prefer to point the inner top surface 220 towards the ground during use. Yet further, rather than being generally cylindrical, the housing may be rectangular, triangular, spherical, semicircular (e.g., a semicircular top and bottom with generally straight side), or football shaped, or other shapes.

An example of a method of using a running device as disclosed herein will now be described. As shown in FIGS. 4A-21C, a person may hold one running device in his or her left hand and another device in his or her right hand while running. For ease of illustration, devices 420R and 420L in the right and left hand, respectively, of runner 400 will be considered structurally identical to running device 100 shown in FIGS. 1-3.

For the purposes of this disclosure, a single running cycle is considered a sequence of movements that a person repeats while running. Those movements may be grouped into a sequence of four phases.

(1) Left launch phase is the span of time during which the runner uses their left foot to propel their center of mass primarily forward and to a lesser extent, upward. For ease of illustration, the left launch phase is considered to begin the moment the left foot exerts maximum force on the ground (left "maximum contact") and end the moment the left foot leaves the ground (left "liftoff").

(2) Midflight phase after left launch is the span of time during which both feet are off of the ground following left liftoff. For ease of illustration, the midflight phase after left launch is considered to begin with left liftoff and end the moment the right foot makes initial contact with the ground (right "initial contact").

(3) Right landing phase is the span of time during which the runner is landing on his or her right foot after being in midflight. For ease of illustration, the right landing phase is considered to begin with right initial contact and end the moment the right foot exerts maximum force on the ground (right maximum contact).

(4) Right launch phase is the span of time during which the runner uses their right foot to propel their center of mass primarily forward and to a lesser extent, upward. For ease of illustration, the right launch phase is considered to begin with right maximum contact and end the moment the right foot leaves the ground (right liftoff).

(5) Midflight phase after right launch is the span of time during which both feet are off of the ground following right liftoff. For ease of illustration, the midflight phase after right launch is considered to begin with right liftoff and end the moment the left foot makes initial contact with the ground (left initial contact).

(6) Left landing phase is the span of time during which the runner is landing on his or her left foot after being in midflight. For ease of illustration, the left landing phase is considered to begin with left initial contact and end with left maximum contact.

FIGS. 4-21 illustrate moments during or between the foregoing phases in accordance with a method of using the running devices disclosed herein. The figures are arranged in order such that the moment shown in one figure number occurs after the moment shown in the preceding figure number and before the moment shown in the next figure number. For instance, the moment shown in FIGS. 5A-5C occurs after the moment shown in FIGS. 4A-4C and before the moment shown in FIG. 6A-6C.

As noted above, the phases are described as starting and ending at certain moments for ease of illustrating a method of using the invention. In practice, a person may start the process of using their muscles to launch off of their left foot before or after the instant their left foot exerts maximum force on the ground. Moreover, it is possible that a person's fascia may start providing a launching force before the person consciously begins using their muscles to do so.

Unless the context indicates to the contrary, references to directions herein are relative to a person's body regardless of how fast the person may be moving. For example, if this application refers to a runner moving an object that is currently in front of them "backwards", this refers to the runner moving the object towards their back even if the net speed of the object relative to the ground is forwards. Similarly, references to an object moving an object "upwards" or "downwards" refers to whether the object is moving with or against the direction of gravity. The forward, backward, left and right directions are considered "horizontal" directions and the up and down directions are considered "vertical" directions. A reference to an object moving perpendicular to one reference plane does not preclude the possibility of the object also moving parallel with the reference plane. For example, if an object is described as having a downward velocity, a component of the object's velocity may also be in a horizontal direction. However, references to an object moving "primarily" (or the like) in one direction means the object is moving faster in that direction relative to other directions. For example, if this application refers to hand moving "primarily backwards", it means that the hand is moving faster backwards than up, down, left or right.

References to the orientation of a running device refer to the orientation of its longitudinal axis. For example, references to device 100 being held primarily upright means the longitudinal axis is within a 0 to 90 angle to parallel than perpendicular to the direction of gravity.

FIGS. 4A-4C illustrate a moment during the midflight phase after left launch in accordance with an example of a method of using the running devices disclosed herein. At the moment shown in FIGS. 4A-4C, the runner's right foot 410R is in front of him and his left foot 410L is behind him, and devices 420R and 420L are at the maximum height they will attain during this phase of the then-current current cycle. Most runners will raise the device in the left hand higher than the device in the right hand during the midflight phase after left launch. Although it is not shown for ease of illustration, runner 400 has his fingers wrapped around the side surface of the devices. As explained in more detail below, material 280 is in contact with inner top surface 220 in both devices 420R and 420L. Frame 25*f* of FIG. 25 also illustrates a moment during the midflight phase after left launch.

In accordance with the example method, the runner quickly thrusts both devices primarily downwards as the runner descends towards landing on his or her right foot. As shown in FIGS. 5A-5C, runner 400 moves devices 420R and 420L with sufficient force 510 and speed to push inner top surface 220 against material 280 with force 510. Shortly before the runner's right foot makes initial contact, the downward speed of the devices may have reached their peek downward velocity and not continue to accelerate. In that regard and as shown in FIGS. 6A-6C, devices 420R and 420L the material may continue traveling downward moving at the same velocity as the housing. As a result, the material may be in a state similar to weightlessness; if the material and housing are moving at the same velocity 730, the material may effectively float inside chamber 200 near inner top surface 220.

As soon as the runner's right foot makes initial contact with the ground, the runner may bring the downward velocity of both devices to a stop as rapidly as he or she safely can. FIGS. 7A-7C illustrate a moment after right initial contact. As close to the moment foot 410R makes initial contact with the ground as he safely can, runner 400 may substantially decelerate the downwards velocity of both devices 420R and 420L. Frame 25*g* of FIG. 25 also illustrates a moment of the method after right initial contact.

Since the material in the device is capable of movement within the chamber, the material may continue traveling downward notwithstanding the housing coming to a stop. By way of example and as shown in FIGS. 7A-7C, housing 160 may have come to a vertical stop but moveable material 280 may continue traveling downward with the same downward velocity 730 it had before runner stopped applying a downward force against the material. Frame 25*h* of FIG. 25 also illustrates the moment of the method when the runner has brought the devices to vertical stop during the right landing phase.

In accordance with the example method, the downward inertia of the material will cause the material to collide with the inner bottom surface of the chamber. For example, as shown in FIGS. 8A-8C, material 280 may transition from a position near the inner top surface 220 to a position near inner bottom surface 221. However, as described in more detail below, the downward velocity 830 during the period of transition may be slower than the downward velocity 730 prior to the transition. FIGS. 9A-9C illustrate material 280 impacting inner bottom surface 221 with force 910.

A running device in accordance with the system and method disclosed herein may include one or more components that delay and/or extend the duration of the downward force exerted by the moveable material on the housing of a running device after the user stops the downward velocity of the housing. While the following paragraphs 0056-0071 reflect one possible theory of operation, the invention is not limited to any specific theory; additional or alternative theories may account for the increased performance benefits observed from runners' use of the device and method.

Figure 22A:
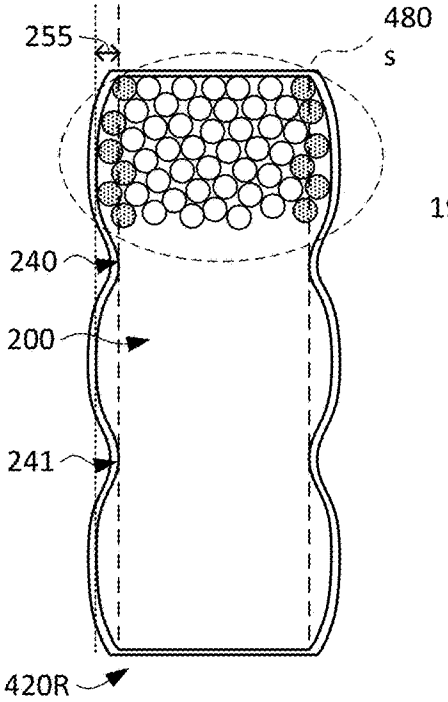
FIGS. 22A-22D are diagrams of how a moveable material may move within a chamber of the example of the running device.
Figure 22B:
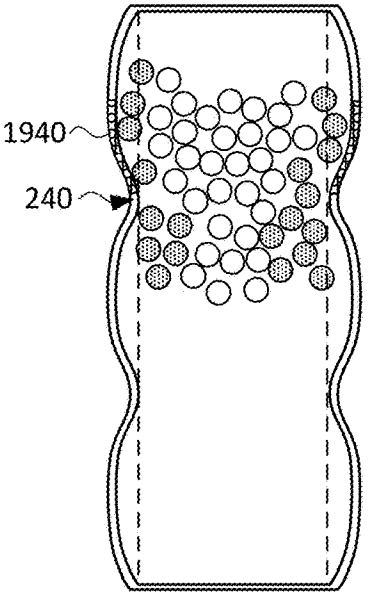
Figure 22C:
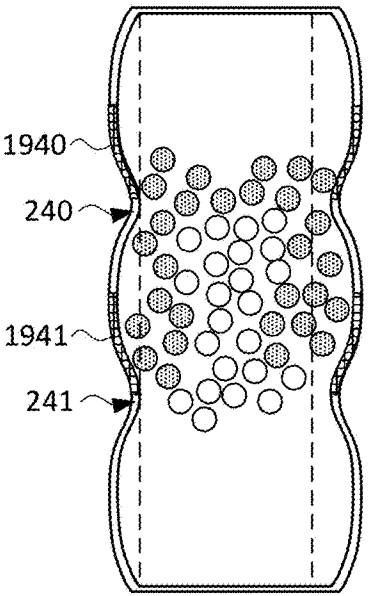
Figure 22D:
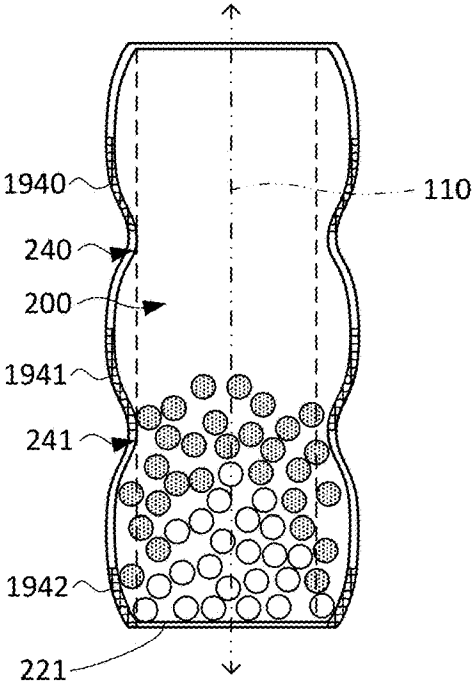

FIGS. 22A-22C illustrate how a delay component may affect the movement of material within the chamber during the landing phase. The delay component of device 100 may include protrusions 240 and 241 and tapered bottom 1942 in combination with a material composed of pellets 480. FIG. 22A diagrammatically illustrates how pellets 480 may appear in chamber 200 of device 420R (and similarly in device 420L) at the moment depicted in FIGS. 5A-C, e.g., a moment wherein all of the pellets are forced against inner top surface of chamber because of the downward force applied by runner 400 to housing 160. When the runner begins to decelerate the housing, inertia will cause pellets 480 to continue downwards. However, since protrusion 240 inwardly extends a distance 255 towards the center of the chamber, the protrusion will slow the progress of at least some of the pellets (shaded for reference). FIG. 22B illustrates a moment after the moment depicted in FIG. 22A, wherein upper portion 1940 of protrusion 240 directly interferes with some of the pellets, which collide with and further slow other pellets. FIG. 22C illustrates how the pellets 480 may appear in chamber 200 of device 420R at the moment depicted in FIGS. 8A-C. At this moment, upper portions 1940 and 1941 of protrusions 240 and 241, respectively, have directly or indirectly interfered with and slowed the downward velocity of even more pellets (shaded for reference). As shown in FIG. 22D, the inner side surface of the chamber 200 proximate to the inner bottom surface 221 may be tapered, which may further delay the collision of at least some of the pellets with inner bottom surface 221 or, in addition or alternatively, concentrate the impact force. Since some pellets will be more affected by the protrusions than other pellets are, the force exerted by the pellets against the housing may be spread out over a longer period of time than the force that would be exerted in the absence of a delay component. The magnitude of that force will also peak later than it would in the absence of delay component. FIG. 22D illustrates the moment at which the material is exerting the maximum amount of force it will assert against inner bottom surface 221 while the runner's foot is in contact with the ground during the then-current cycle. (The elements of FIGS. 22A-22D have been scaled and shaped for ease of illustrating a theory of operation. The invention is not limited to the theory of operation disclosed herein and the actual interaction among the illustrated elements may be different than those shown in FIGS. 22A-22D.)

Figure 23A:
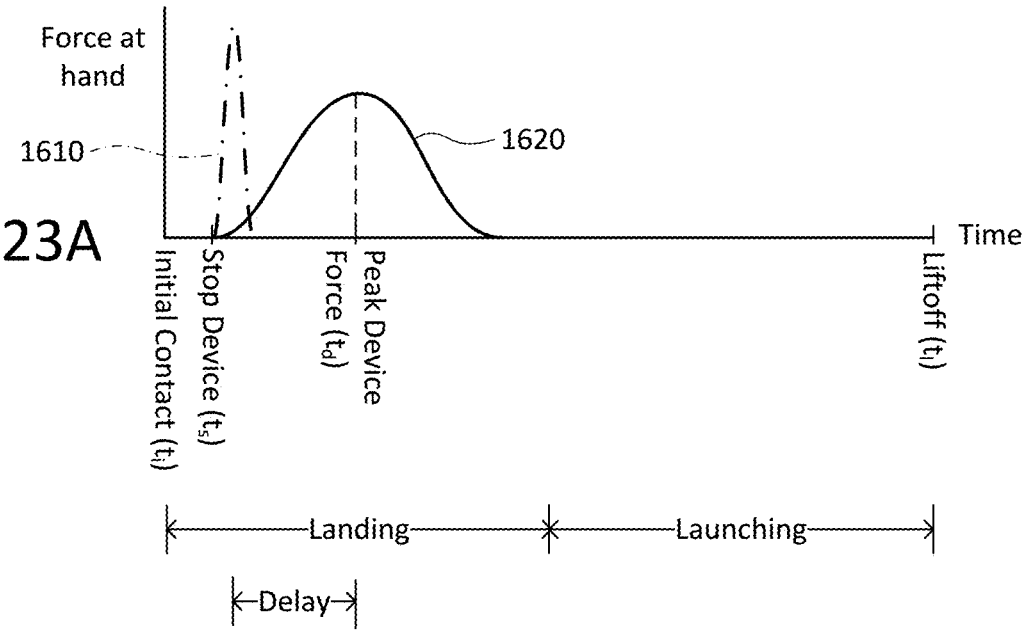
FIGS. 23A-23B are graphs of forces associated with a method of using a running device.
Figure 23B:
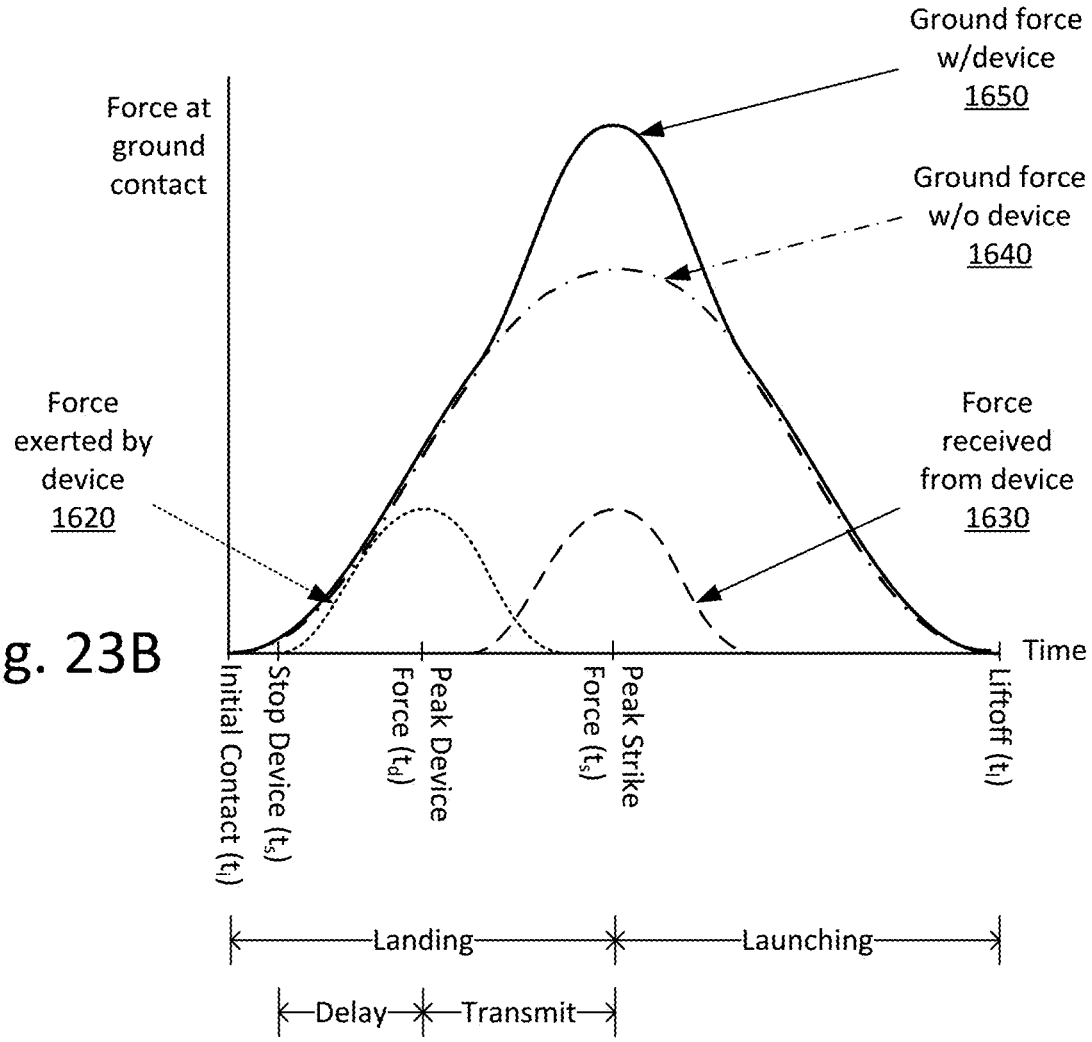

FIGS. 23A-23B provide a graph of the force that a running device with a delay component is believed to transmit to a person's hand and foot when the moveable material strikes the device's housing with downward force. As noted above in connection with FIGS. 7A-C, when the runner makes initial contact with the ground after being in midflight ($t_i$), the runner may attempt to bring the downward velocity of both devices to a stop as soon as they are able to safely do so ($t_s$). In FIG. 23A, curve 1610 represents the force that the moveable material may exert against the housing when the device does not include a delay component and curve 1620 represents the force that the moveable material may exert against the housing when the device includes a delay component. Compared to a device with a delay component, the material in a device without a delay component delivers its force very quickly after the device is stopped and over a very short period of time (curve 1610). However, as shown by curve 1620 and the dimension labeled "delay" in FIG. 23A, and as explained above in connection with FIGS. 22A-22D, the delay component slows the material so the force builds more slowly and peaks later than it would in the absence of a delay component. (The elements of FIGS. 23A and 23B have been scaled and shaped for ease of illustrating a theory of operation. The invention is not limited to the theory of operation disclosed herein and the actual forces that result from a runner using devices 420R and 420L may be different than those shown in FIGS. 23A-23B.)

The force exerted by the material against the housing of the running devices will be transmitted to the structural tissues in the runner's hand and wrist, including muscles and the fascia surrounding those muscles.

Fascia is typically loose and malleable. However, when force (e.g., pressure) is applied to fascia, it may become rapidly tense and transfer at least some of the force to the surrounding neighboring muscle or other organs, including the fascia network proximal up the arms toward the torso. Fascia may be likened to a large interconnected network that surrounds the muscles and structurally integrates them with the tendons and other connective tissues, and is capable of directly or indirectly translating a force experienced at one part of the body to other parts of the body. If the maximum force imparted by the housing of the device to the runner's hands in the downwards direction ("peak device force") is large enough, at least some—if not most—of that downward force will be transmitted through the runner's arms, torso and legs to the foot in contact with the ground.

Fascia provides other functions that may be relevant to the running devices and method of use disclosed herein. First, fascia provides an elastic-like recoil effect that returns at least some of the force that it receives. In this way, fascia is similar to a spring; the greater the force with which a runner's foot strikes the ground, the greater the speed and power the runner will get off of the ground because of the energy stored and returned by fascia and its structural continuity with the muscles, tendons, ligaments and bones. Second, fascia decreases the amount of energy and mechanical work that a muscle needs to expend. Without the fascia, muscles would have to do more work and spend more energy pushing a runner back up off of the ground after they land.

Fascia is believed to be capable of transmitting at least some of the force exerted by the device on the runner's hand to the foot's area of contact with the ground very quickly. While the amount of time it may take for the force from the device to be translated to the foot may be very short, the total amount of time that the runner's foot spends on the ground between landing and liftoff ($t_i$ to $t_1$) may be very short as well, e.g., 0.1 seconds. Therefore, even if it only took two hundredths of a second to transmit the force from the device to the ground, that span of time may be relatively significant compared to the amount of time that the runner's foot is in contact with the ground.

The delay between the device's delivery of force to the hand and the transmission of that force to the foot is illustrated in FIG. 23B. The horizontal distance between the curve 1620 ("Force exerted by the device") and the curve 1630 ("Force received from device"), which is represented by the dimension labeled "Transmit", illustrates that delay. Curve 1640 ("Ground force w/o device") represents the amount of force that a runner's foot may exert on the ground in the absence of running devices such as those disclosed herein. The moment labeled "peak strike force" ($t_s$) represents the moment at which the runner would exert maximum force on the ground in the absence of such devices.

It is believed the force transmitted by the running devices may increase the force a runner exerts on the ground between each landing and launch. As shown by curve 1650 ("Ground force w/device"), if the time at which the peak device force is received at the foot coincides with the peak strike force, the overall force with which the runner hits the ground may be significantly increased.

Figure 24:
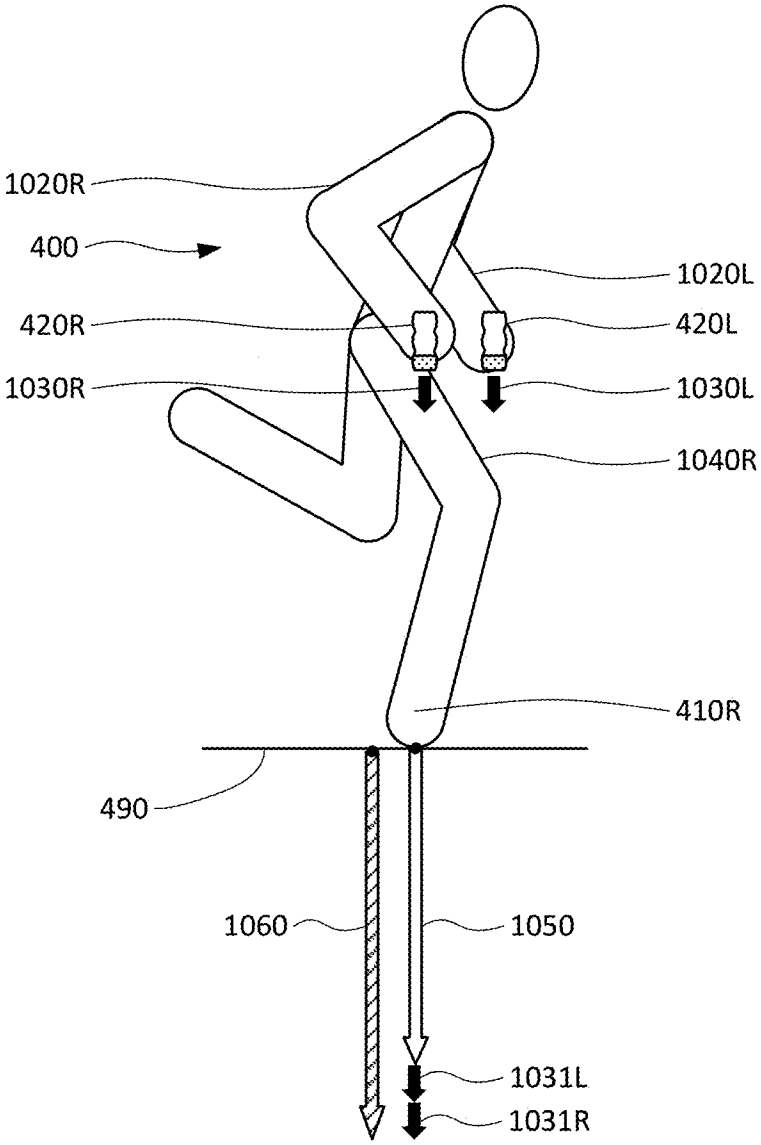
FIG. 24 is a diagram of forces associated with a method of using a running device.

FIG. 24 is a diagram of forces associated with the aforementioned theory of operation. Vectors 1030R and 1030L represent the magnitude and direction of the peak device force exerted by devices 420R and 420L on the runner's right and left hands, respectively. Vector 1050 represents the magnitude the peak strike force that would be exerted downwards by runner 400 on the ground plane 490 in the absence of the devices. The runner's fascial network may transmit the peak device forces 1030R and 1030L via, in order, the runner's arms 1020R and 1020L, the runner's torso, and the runner's right leg 1040R, and finally arrive at ground plane 490 as downward forces 1031R and 1031L. While forces 1031R and 1031L may be less than forces 1030R and 1030L due to absorption, forces 1031R and 1031L may still combine with the peak strike force 1050 to increase the overall force 1060 with which the runner strikes the ground.

All other factors being equal, and provided the various forces are within safe limits, the harder a runner hits the ground, the better the runner will typically perform. It is believed that the harder a runner lands on the ground, the greater the proportion of work done and managed by the fascia and other connective tissues such as the tendons versus the muscle fibers themselves. The harder landing increases the recoil effect from fascia and decreases the eccentric elongation of the muscle fibers, which propels the runner forward at a faster speed with less energy cost. Moreover, because the rebound is more powerful, hitting the ground harder results in less ground contact time, which may reduce soreness and repetitive stress. Therefore, use of the running devices disclosed herein in accordance with the method described in connection with FIGS. 4A-21C is believed to enable a person to run faster, more efficiently and with less wear and tear than running without devices using the swinging arms technique.

It is believed that if the running devices lacked a delay component, at least some of the benefits provided by using the running devices with the disclosed method would be decreased. For example, if the force is too concentrated (e.g., not distributed over time as shown in FIG. 23A), the force may appear and disappear too quickly for the body's fascia to transmit the force to the ground plane. Moreover, if the peak device force arrives and dissipates at the ground plane before the peak strike force, the force may be both wasted and interfere with the runner's rhythm.

Yet further, as noted above, a runner using a running device with a delay component may synchronize when they start to decelerate the downward motion of the devices with an easily perceivable event: the moment of initial ground contact. In the absence of a delay component, a runner would need to start the process of stopping the device in the middle of the landing phase at a time that coincides with the length of time it takes for the device force to the transmitted to the ground plane. It is believed that most runners would find it difficult to know exactly when to start decelerating the devices if it has to occur at a specific time between initial contact and peak strike force.

Regardless of the theory of operation, athletes have been observed in time trials to run faster holding a device similar to running device 100 in each hand (or holding only one device) and running as described above than the same athletes normally run in the absence of the devices. Yet further, some people have been observed to run faster using aspects of the disclosed method (thrusting one's hands downward while in midflight and then bringing them to a stop after landing) even without the devices. In that regard, the disclosed running devices may be used to train athletes in the disclosed running technique and run with greater speed and less energy without devices than using the swinging arms technique.

The magnitude and timing of the peak device force depends at least in part on how quickly the runner thrusted the devices downward prior to initial contact (e.g., the peak downward velocity of the material prior to initial contact is a function of the rate at which the runner accelerated the housing downward during the second half of the midflight phase) and how quickly the runner brought the devices to a vertical stop (e.g., the rate of deceleration of the housing of the devices upon or after initial contact). In order to increase the peak device force, some runners may intentionally continue to accelerate the running devices downwards for a short time after initial contact (in order to increase the velocity of the moveable material), or may begin accelerating the devices upwards prior to impact (in order to increase the velocity of the moveable material relative to the inner bottom surface)).

However, even if a runner reaches a plateau with respect to how quickly he or she is able to accelerate and decelerate the devices, the runner may still be able to increase their performance by changing one or more characteristics of the running device. For example, as noted above, device 100 may include a removable cap for adding, removing or changing the material 280 in the device. If the runner is able to move a heavier device just as quickly, increasing the mass of the moveable material may increase the peak strike force. In order to obtain the greatest improvement in running speed, it is believed the runner should adjust the mass of the moveable material to safely and consistently deliver the greatest peak device force with the appropriate delay component to transmit the peak device force though the body to the foot to coincide with the moment the runner's foot is exerting its greatest force against the ground. If the runner's peak device force continuously arrives too late or early relative to peak strike force, the runner may decrease or increase the size of the pellets to hasten or further delay the arrival of peak device force after initial contact.

The material from which the housing is composed may also affect peak device force. By way of example, housing 160 may be composed of polyvinyl chloride (PVC) with variable durometers (hardnesses). The harder the PVC, the greater the impact force. The arrival and magnitude of the peak device force may be further delayed or decreased, respectively, by coating the inner surface of the chamber with a material (e.g., rubber) having a relatively high coefficient of friction with respect to the moveable material (e.g., steel pellets). A softer housing or moveable material may not only be relatively quiet, but it may also be easier for people that are not strong as a typical user or those who intend to use the running device for longer distances.

In accordance with the example method, after the runner brings the downward velocity of the running devices to a vertical stop, the runner may begin raising both devices primarily upwards. For instance, during the right launch phase shown in FIGS. 10A-10C, runner 400 accelerates housing 160 of running devices 420R and 420L primarily upwards, which causes inner bottom surface 221 to exert an upwards force against material 280. It is believed that much of the work to raise the running devices in this phase is performed via the recoil reaction of the fascia, thus enabling the runner to raise the devices relatively rapidly. Although the example of FIGS. 9A-9C and 10A-10C assume the runners begin lifting the running device after both the peak device force and peak strike force, some runners may reverse the vertical direction of the devices before the material collides with the inner bottom surface in order to increase the magnitude of the peak device force. Frame 25*a* of FIG. 25 also illustrates the runner raising the devices primarily upwards prior to right lift off.

Before the runner's hands reach their maximum height during the midflight phase, the runner may begin bringing the upwards velocity of running device to a stop in preparation for thrusting the devices back down. Since the material in each device is capable of movement within the chamber, the material may continue traveling upwards notwithstanding the housing coming to a stop. By way of example and as shown in FIGS. 11A-C, housing 160 may be in or nearing a state of transition from moving upwards to downwards, material 280 may continue traveling upward with the same velocity 1110 it had before the runner stopped applying an upward force against the material. In that regard as shown in FIGS. 12A-C, material 280 may transition from a position near the inner bottom surface 221 to a position near inner top surface 220. However, because of the delay component and force of gravity, the upward velocity 1210 during the period of transition may be slower than the upward velocity 1110 prior to the transition. Frame 25*b* of FIG. 25 also illustrates the runner bringing the devices to vertical stop while in midflight. FIGS. 13A-C illustrate material 280 impacting inner top surface 221 with upward force 1310.

The upward force of the material impacting the top surface of housing may be transmitted to the runner's body in a manner similar to the downward force impacting the bottom surface of the material. However, rather than the force being translated to the ground, the upward force may cause the fascia to tense and raise the person's center of mass higher than it would have risen in the absence the devices. The additional height may help runners hit the ground harder and may also help runners that could benefit from more time aloft.

The method of using the devices during the left landing and launch phases, and the halves of the midflight phases that precede and follow them, respectively, is similar to the method described in connection with FIGS. 4A-13C and the right landing and launch phases. In that regard, the description of the method associated with FIGS. 14A-15C (second half of the midflight phase after right launch), FIGS. 16A-18C (left landing phase through and including left maximum contact), FIGS. 19A-19C (left launch phase), and FIGS. 20A-21C (first half of the midflight phase following left launch) apply to FIGS. 5A-6C, 7A-9C, 10A-10C and 11A-12C, respectively, as well, except references to the left and right devices, hands, feet, etc., are reversed.

When using running devices as described herein, a runner may increase their performance by shifting their head towards the side of the body that corresponds with the foot that is currently in contact with the ground. For example, as shown in FIGS. 9A-9C, the head of runner 400 may shift towards the right during right maximum contact and, as shown in FIGS. 18A-18C, the head of runner 400 may shift towards the left during left maximum contact.

Figure 27:
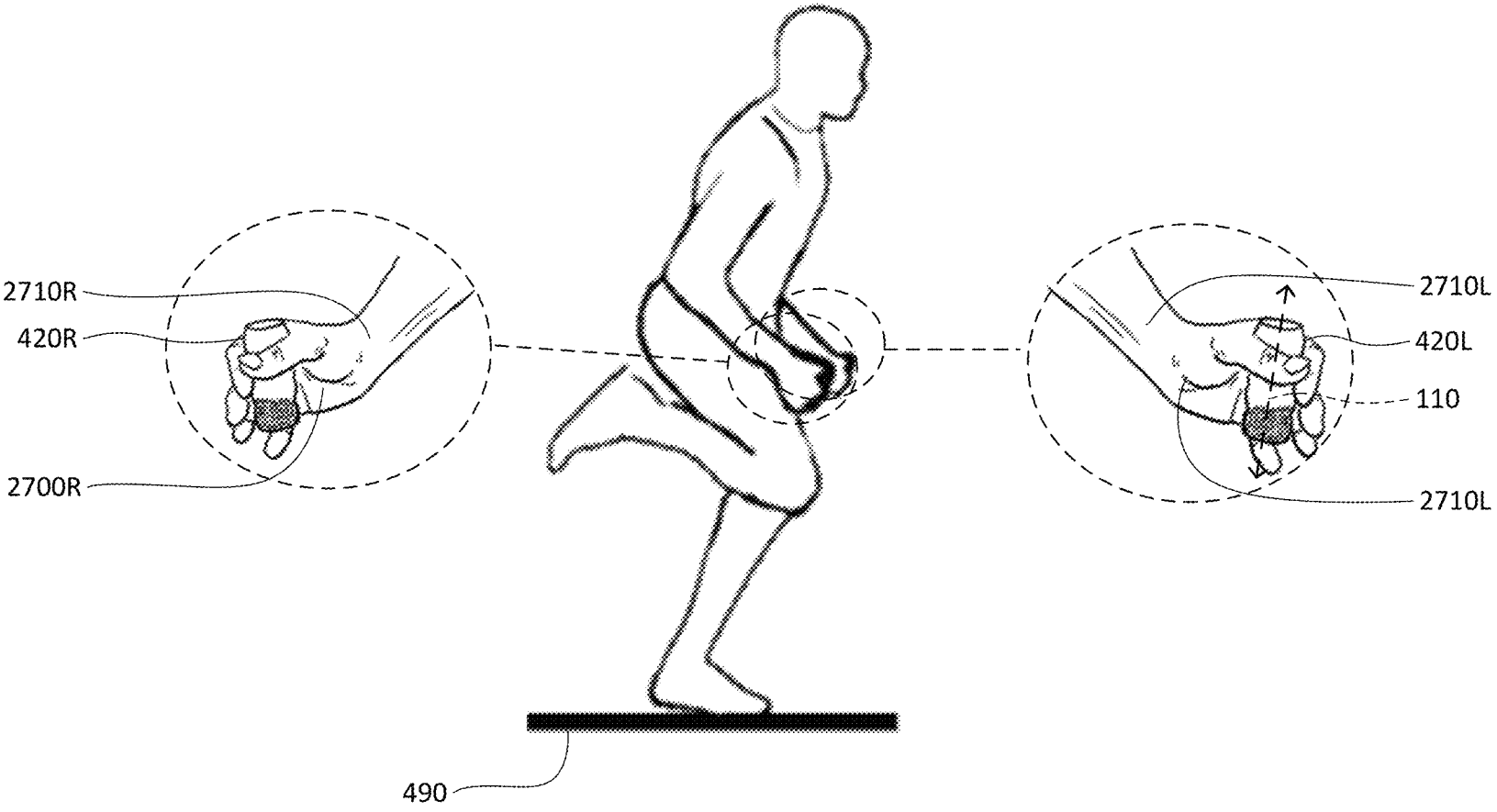
FIG. 27 is a diagram of a method of using a running device.

When stopping the downward velocity of the running devices, a runner may further increase performance by keeping his or her left and right wrists at the positions shown in FIG. 27. The runner may cock their left hand 2700L and left wrist 2710L (e.g., extend their left wrist with radial deviation) so the longitudinal axis 110 of the device 420L is primarily perpendicular to ground plane 490. This position may also arrange the extensors and flexors of the forearms, as well as the biceps, *brachialis* and brachioradialis (and other muscles) of the upper arm to transmit the force from the devices with less restriction and greater energy efficiency. This position may also prevent more pellets from hitting the sides of the chamber than necessary.

The running devices may provide audio feedback to assist the runner with timing their motions. For instance, the housing may be structured to project the sound of the impact of material 280 with the inner top surface 220 and inner bottom surface 221 out of the device. By way of example, the housing between outer top surface 120 and inner top surface 220, and outer bottom surface 121 and inner bottom surface 221, may be composed of PVC with a relatively high durometer, which may make the collision of material 280 with the top and bottom surfaces not only audible but relatively loud. Materials such as polypropylene, polyethylene, nylon and other plastics that provide a light weight and substantially rigid housing may provide an audible feedback that can be heard by the user. The repetitive sound of the contact may help the runner coordinate their deceleration of the devices with the rhythm of their running. Moreover, since the volume of the collision is dependent on the magnitude of the force that the moveable material exerts on the housing, and since that force is dependent on how quickly the runner is able to accelerate and decelerate the device, the relative volume projected from the device may help the runner and the people training the runner determine whether the runner is moving and stopping the device quickly enough to optimize its benefits.

Figure 25:
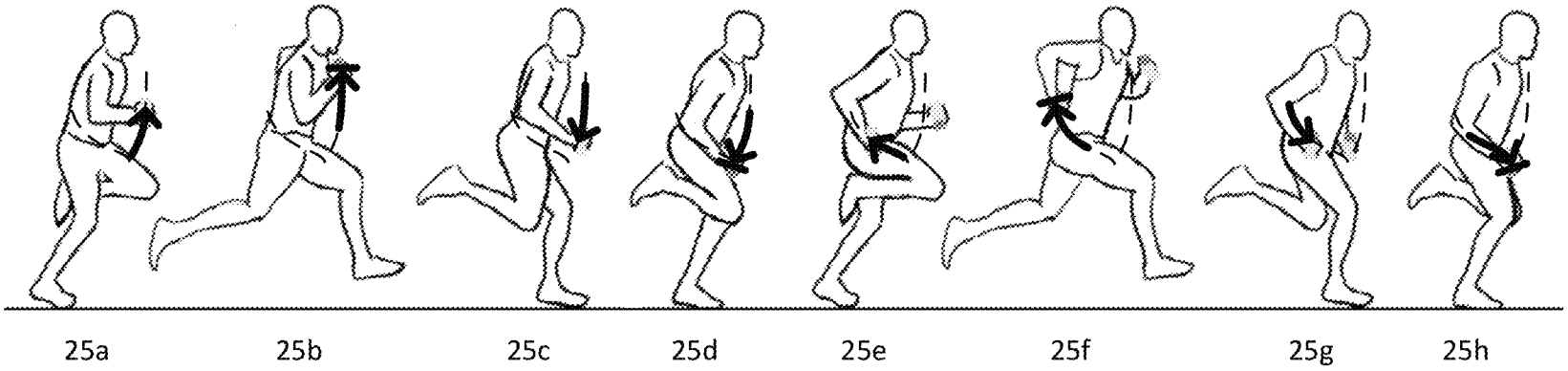
FIG. 25 is a side view of a method of using a running device.
Figure 26:
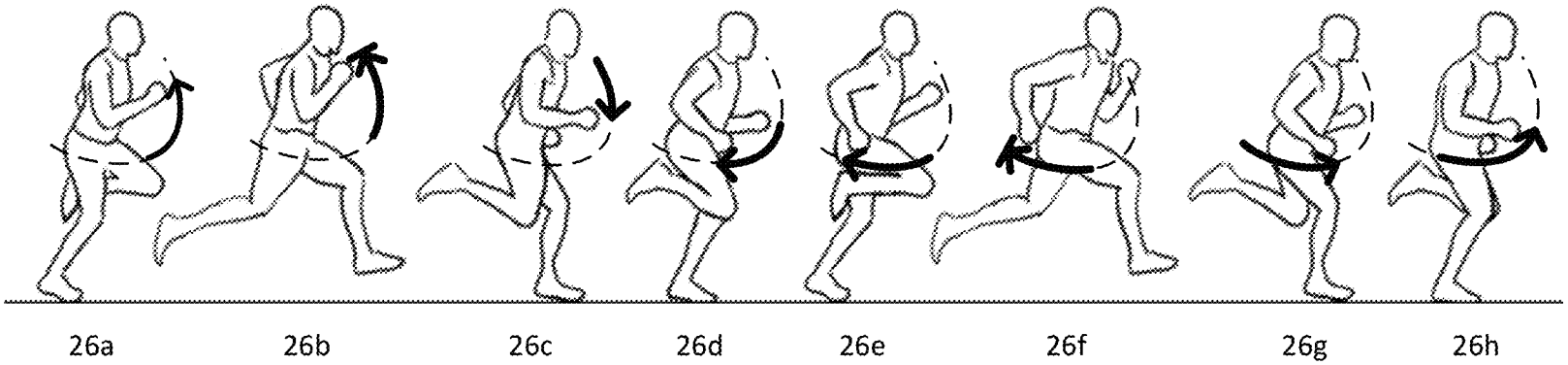
Fig. 26 (Prior Art)
FIG. 26 is a side view of prior art running technique.

The difference between the swinging arm technique and the method of using the running devices as disclosed herein may be seen in a comparison of the side view of the swinging arm technique in FIG. 26 with the side view of the disclosed method in FIG. 25. In the swinging arm technique, right before a foot exerts its maximum force, one hand is typically moving primarily backwards and the other hand is moving primarily upwards (FIG. 26, frames 26*d* and 26*h*). As a result, the technique provides little to no additional ground force. When using the devices as disclosed herein, right before a foot exerts its maximum force against the ground, the runner's hands and the devices are moving primarily downward, which is believed to augment the runner's ground force and increase performance (FIG. 25, frames 25*d* and 25*h*).

FIGS. 30-33 illustrate a running device that may be worn when used in connection with the disclosed method.

Figure 30:
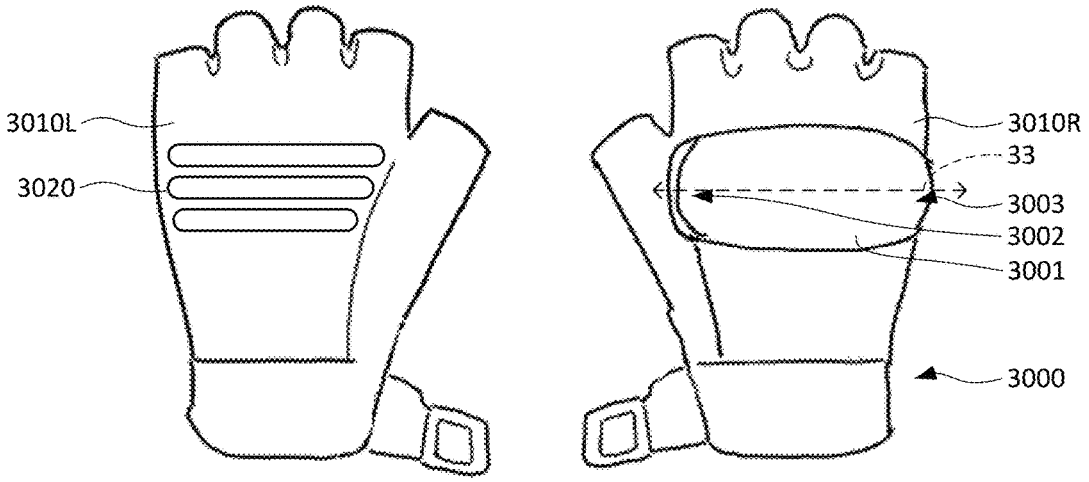
FIG. 30 is a top view of still another example of a running device.

As shown in FIG. 30, running device 3000 may include a wearable portion in addition to the portion that contains a moveable material. By way of example, running device 3000 may include right-handed glove 3010R and cartridge 3001, which contains a moveable material. Unlike running device 100, which is held in the runner's palm, glove 3010R places the cartridge next to the back of the hand. A wearable running device may help runners that have difficulty holding onto a running device while running. The glove may be further structured and arranged to require or encourage a runner to position his or her wrists as shown in FIG. 27. For instance, the fastener strap may be structured and arranged to facilitate the user's ability to position and hold their wrists in a 'cocked' position as shown in FIG. 27, and the material proximal to the radial side of the wrist (thumb side) may be elastomeric and have an enlarged opening to facilitate the 'cocked' wrist position. The wearable portion of a running device as disclosed and used herein is not limited to gloves. For example, the wearable portion may be a wrist band, finger loops or straps the user locates on one of more fingers. The cartridge may also be positioned on either the palmer or dorsal portion of the wrists and/or hands, and capable of being positioned at variable angles to optimize the alignment of the longitudinal axis of the cartridge to the gravitational force.

Figure 31:
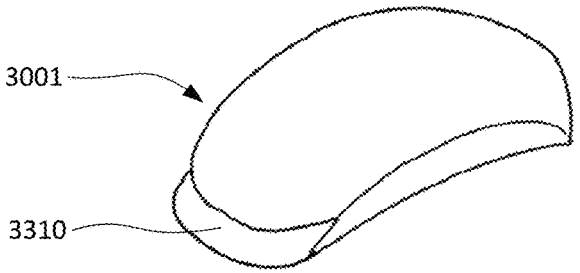
FIG. 31 is an isometric view of the example of a running device shown in FIG. 30.
Figure 32:
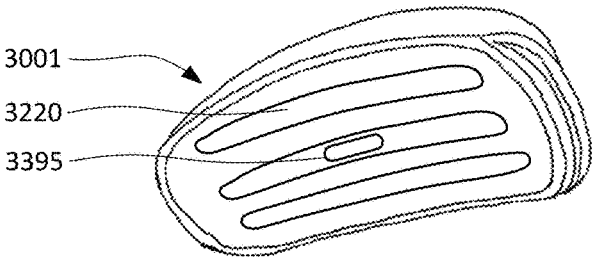
FIG. 32 is another isometric view of the example of a running device shown in FIG. 30.
Figure 33:
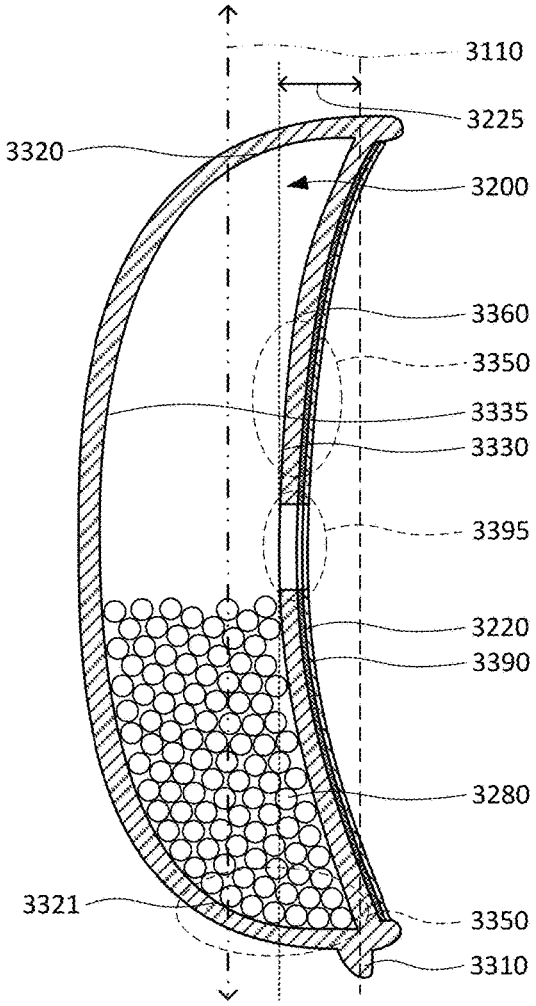
FIG. 33 is a side cross-sectional view of the example of the running device shown in FIG. 30.

The cartridge may be removably attached to the wearable portion. By way of example, left-handed glove 3010L (shown without a cartridge 3001), may include hook-and-loop fastening strips 3020 that are capable of securely attaching cartridge 3001 to the glove. A portion of the outer surface of the cartridge 3001 may include corresponding hook-and-loop fastening strips 3220 (FIG. 32). As shown in FIG. 33, which is a cross-sectional view of cartridge 3001 relative to reference plane 33 (FIG. 30), fastening strips 3220 may be glued to a PVC sheet 3390 or mechanically stitched, which is affixed to the outer surface of housing 3360. FIG. 31 provides an isometric view of a portion of cartridge 3001 that is visible to the runner when the cartridge is attached to the wearable portion. As shown in that figure, cartridge 3001 may include a pull tab 3310 to make it easier for the cartridge to be separated from the wearable portion. Other removable fasteners may also be used (e.g., zippers or snaps). Alternatively, the portion of a running device that contains the moveable material may be permanently attached to the wearable portion.

The cartridge may include an inner chamber that includes a moveable material. During operation, a runner will orient his or her hands so the back of hand faces outward and to the side (e.g., as compared to upwards), in which case left longitudinal end 3002 of cartridge 3001 attached to right-hand glove 3010R will point upwards and right longitudinal end 3003 will point downwards relative to the cartridge's center of mass. In that regard, housing 3360 of cartridge 3001 defines an inner chamber 3200 having a inner top surface 3320, inner bottom surface 3321, inner left side surface 3335 and inner right side surface 3330 relative to longitudinal axis 3110. Moveable material 3280 may be similar to moveable material 280, e.g., steel pellets. The cartridge may provide users with access to the chamber. For example, hole 3395 may permit users to add or remove material from the chamber.

The inner side surfaces of the chamber may be concave or convex. For instance, inner right side surface 3330 arcs inward for a distance 3225 (relative to the maximum width of the inner chamber 3200), and inner left side surface 3335 arcs outwards. The bottom portion 3350 of chamber 3200 tapers inwards.

Running device 3000 may be operated similar to the method of using running device 100 described above. For instance, a running device 3000 with a left-handed glove portion may be worn on the left hand and a running device 3000 with a right-handed glove portion may be worn on the right hand. A runner may thrust their hands and running devices quickly downwards prior to landing, and bring housing 3360 to a vertical stop after landing. Moveable material 3280 may continue moving towards inner bottom surface 3321 notwithstanding housing 3360 coming to a vertical stop. However, a portion 3350 of the inner right side surface 3330, in combination with the nature of moveable material 3280 (e.g., pellets), may provide a delay component that delays the arrival of the peak device force.

As noted above, the timing and magnitude of the device may depend on various characteristics. With running device 3000, a user may select a cartridge that most closely matches their preferences. For instance, given the choice between two cartridges that are identical but for the hardness of the housing, an experienced runner may select the cartridge with the greater hardness.

Figure 28:
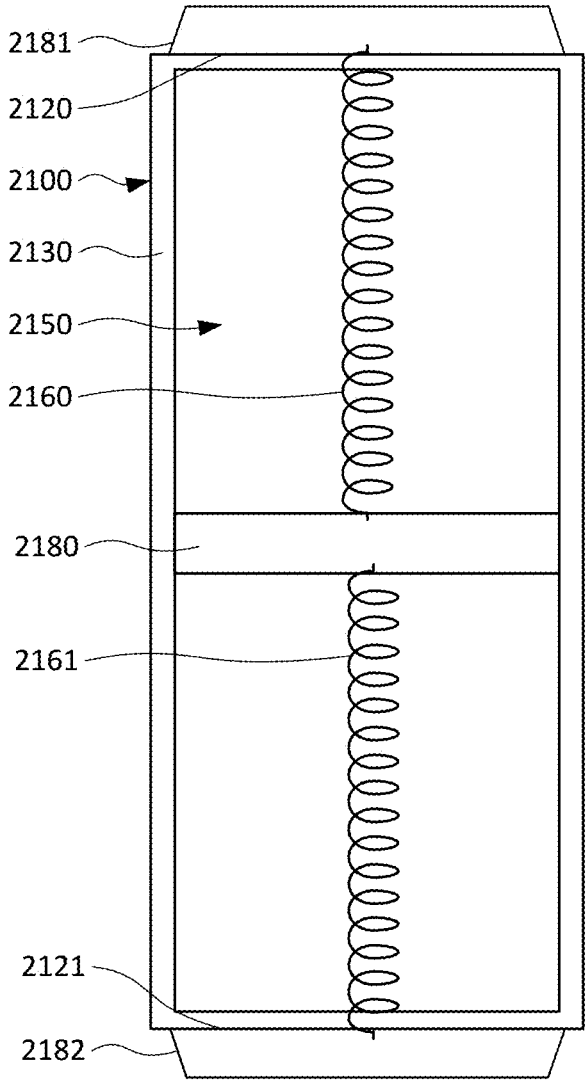
FIG. 28 is a diagram of another example of a running device.
Figure 29:
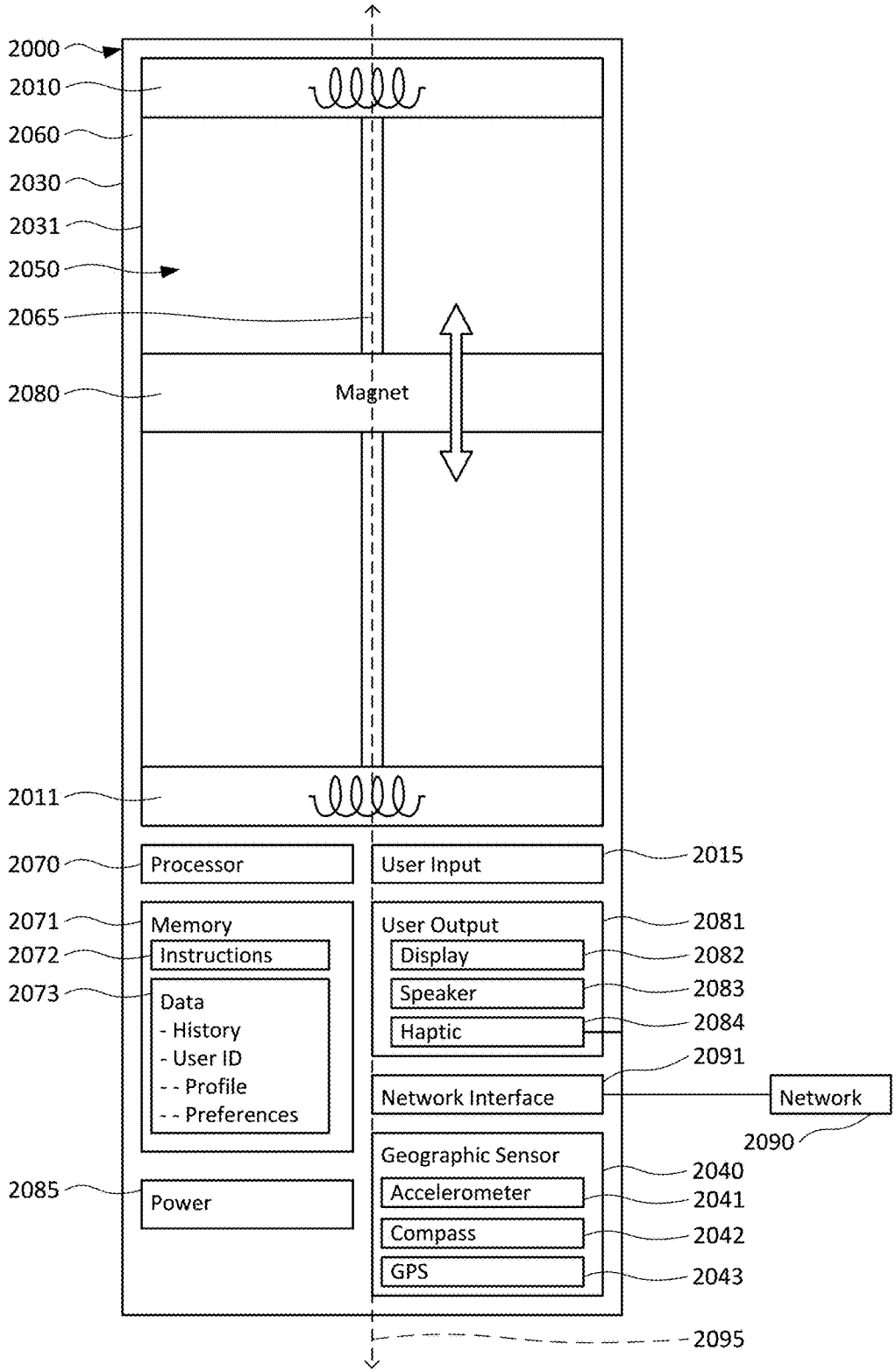
FIG. 29 is a diagram of yet another example of a running device.

FIG. 28 illustrates a running device with a mechanically adjustable delay component. Running device 2100 includes a solid moveable material 2180 (e.g., metal or a heavy plastic) disposed within inner chamber 2150 of housing 2130. Top spring 2160 extends from the moveable material 2180 to the top of the inner chamber and bottom spring 2161 extends from moveable material 2180 to the bottom of the inner chamber. One end of top spring 2160 is connected to dial 2181, which is rotatable and attached to outer top surface 2120 of the housing. One end of bottom spring 2161 is connected to dial 2181, which is rotatable and attached to outer bottom surface 2121 of housing 2130. The runner may turn the dials to increase or decrease the tension in the springs to increase or decrease the delay of the peak device force.

FIG. 28 illustrates a running device 2000 with an electronic delay component. Running device 2000 includes a housing 2060 having an inner housing surface 2031 and outer housing surface 2030, wherein both the inner housing surface and outer housing surface are generally cylindrical. Inner housing surface 2031 defines a cylindrical inner chamber 2050, within which a disc-shaped magnet 2080 is slidably disposed on spindle 2065, which extends along the longitudinal center of inner chamber 2050. Electromagnets 2010 and 2011 are disposed along the top and bottom surfaces, respectively, of inner chamber 2050. Running device 2000 may also include sensors (not shown) capable of determining the position of magnet 2080 relative to the top and bottom surfaces of chamber 2050.

Processor 2070 executes instructions 2072 and processes data 2073 stored in electronic memory 2071. Processor 2070, memory 2071, and electromagnets 2010 and 2011 are powered by power source 2085 (e.g., a battery). Processor 2070 is further capable of changing the amount of power directed towards each electromagnet to propel magnet 2080 towards, and potentially into contact with, the top or bottom surface of inner chamber 2050 in accordance with instructions 2072.

Running device 2000 may include user input and output components. For example, user input component 2015 may include a touchscreen or buttons. User output component 2081 may include an electronic display 2082 (e.g., a touchscreen or individual LED lights), speaker 2083 and haptic feedback 2084. The running device may also include a network interface 2091 (e.g., USB, Wi-Fi, Bluetooth or cellular) to provide and receive information via network 2090 from another running device (e.g., a similar running device in the person's other hand) or a computing device (e.g., personal computer, smart phone, tablet or web server).

Running device 2000 further includes a geographic sensor component 2040, which senses one or more of the position, velocity and acceleration of housing 2060 in one or more geographic directions. The geographic direction(s) may be relative to the starting position of housing 2060, the earth or some other reference system. For example, accelerometer 2041 may detect changes in the pitch, yaw and roll of the housing relative to longitudinal axis 2095. Compass 2042 may determine geographic direction in which the housing is pointed (e.g., the compass direction in which longitudinal axis 2095 or the portion of the housing containing user output component 2081 is pointed). GPS receiver 2043 may determine the GPS position of the housing (e.g., its current latitude, longitude and height coordinate).

In operation, a runner may operate running device 2000 similar to the method of operation described in connection with FIGS. 4A-21C. For example, the runner may hold one running device 2000 in each hand, thrust both devices upwards as the runner launches from their left or right foot, thrust both devices downward prior to landing, and stop the vertical direction of the running devices after their left or right foot lands.

Whereas the delay component in running device 100 was based on the shape of the chamber's inner side surface and a pellet material, the delay component in running device 2000 may be based on the electromagnets at the top and bottom surfaces and magnetic nature of the moveable material. For example, when executing instructions 2072, processor 2070 may determine whether the signal from geographic sensor component 2040 indicates housing 2060 has started decelerate its downwards velocity. If so, processor 2070 may increase the power to electromagnetic 2011 to delay the collision of magnet 2080 with the bottom surface of chamber 2050. Processor 2070 may also store in memory 2071 a history of when the magnet 2080 contacts the inner top and bottom surfaces, or reversed direction due to magnetic repulsion, relative to the vertical velocity of the device. If it appears the magnet is stopping too early or too late (e.g., housing 2060 continues moving downward after the magnet 2080 hits the bottom surface or reverses direction), processor 2070 may automatically and accordingly adjust when and how much power the processor applies to the electromagnets. The processor may also make a micro-adjustment to the operation of the delay component, determine how fast the runner ran after the adjustment (e.g., based on information provided by the GPS receiver and electronic clock (not shown)), and maintain or revert the adjustment based on whether the runner's speed increased or decreased, respectively.

The runner may also use user input component 2015 to change the operation of the delay component, and processor 2070 may store the preference as data 2073. Running device 2000 may also store different preferences for different users of the device.

Running device 2000 may also permit a runner to select a profile and adjust the operation of the delay component based on the profile. For example, if the runner selects a profile that indicates they are experienced and stronger than average, processor 2070 may automatically increase the speed of the magnet as it is moving upward or downward to increase the force of the impact of the magnet against the top and bottom surface of the chamber, or the force resulting from reversing the direction of the magnet due to magnetic force.

Running device 2000 may provide additional assistance to the runner. For instance, speaker 2083 may emit a tone, haptic feedback 2084 may vibrate and display 2082 may flash to indicate when the runner should stop moving the device downward. The device may also automatically increase the speed of the magnet upward or downward to increase the force of the impact of the magnet against the top and bottom surface of the chamber.

The running device may also upload or download information relating to the runner to and from a network such as the Internet. For example, a user may opt to download profiles from the Internet or upload a history of their performance (e.g., how far and fast they ran, and a history of how the timing of the peak device force corresponded with the downward velocity or height of the housing). Additionally, running device 2000 may also set variable cadences that enable a runner to attune their stride frequency with preset or variable frequencies to vary the tempo at which they run with the aid of the device.

A non-electronic version of running device 2000 may include permanent magnets instead of electromagnets 2010 and 2011, wherein their polarity is arranged to repel magnet 2080.

As these and other variations and combinations of the features discussed above can be utilized without departing from the claimed subject matter, the foregoing description of the embodiments should be taken by way of illustration rather than by way of limitation. The provision of examples (as well as clauses phrased as "such as," "e.g.", "including" and the like) should not be interpreted as limiting the claims to the specific examples; rather, the examples are intended to illustrate only some of many possible aspects. Similarly, references to "based on" and the like means "based at least in part on".

The invention claimed is:

1. A method of using a first running device and a second running device, the first running device being gripped by or removably affixed to the left hand and the second running device being gripped by or removably affixed to the right hand, each running device comprising:

a closed inner chamber defined at least in part by an inner top surface and an inner bottom surface facing the inner chamber, the top surface and the bottom surface further defining a longitudinal axis extending from the top surface to the bottom surface, a moveable material disposed within the inner chamber and configured to provide a gap between the moveable material and the top surface when the moveable material is in contact with the bottom surface and to provide a gap between the moveable material and the bottom surface when the moveable material is in contact with the top surface, a housing containing the inner chamber and the moveable material, and configured to be gripped by or removably affixed to a hand;

the method comprising:

as the left foot is launching, raising both running devices such that the moveable material in the first running device is pushed against the bottom surface of the inner chamber of the first running device and the moveable material in the second running device is pushed against the bottom surface of the inner chamber of the second running device;

when both feet are off the ground, lowering both running devices, such that the moveable material in the first running device changes from being pushed against the bottom surface to being pushed downward by the top surface of the first running device and the moveable material in the second running device changes from being pushed against the bottom surface to being pushed downward by the top surface of the second running device;

when the right foot is in contact with the ground, decelerating both running devices, such that the moveable material in the first running device collides with the bottom surface of the inner chamber of the first running device when the right foot is in contact with the ground and the moveable material in the second running device collides with the bottom surface of the inner chamber of the second running device when the right foot is in contact with the ground; and as the right foot is leaving the ground, raising both running devices such that the moveable material in the first running device is pushed against the bottom surface of the inner chamber of the first running device and the moveable material in the second running device is pushed against the bottom surface of the inner chamber of the second running device.

2. The method of claim 1 wherein each of the first running device and second running device further comprise a delay component, wherein the delay component delays when a peak force is exerted by the moveable material against the bottom surface of the inner chamber after the running device is decelerated.

3. The method of claim 2 wherein the delay component comprises a protrusion extending into the inner chamber and the moveable material comprises a plurality of pellets.

4. The method of claim 3 wherein the delay component further comprises a plurality of protrusions extending into the inner chamber and housing is tapered inward adjacent the bottom surface of the inner chamber.

5. The method of claim 4 wherein the housing comprises an outer surface having a plurality of indentations.

6. The method of claim 2 wherein the delay component comprises a spring between the bottom surface of the inner chamber and the moveable material.

7. The method of claim 2 wherein the delay component comprises a magnet disposed at the bottom surface of the inner chamber and the magnet is arranged to repel the moveable material.

8. The method of claim 1 wherein each running device further comprises a glove and wherein the housing is removably attached to the glove.

9. The method of claim 1 wherein each running device further comprises a removable cap providing access to the inner chamber.

10. A method of using a first running device and a second running device, the first running device being gripped by the left hand and the second running device being gripped by the right hand, each running device comprising:

a housing having a generally cylindrical outer surface and a generally cylindrical inner side surface, an inner top surface, an inner bottom surface, the housing, inner top surface and inner bottom surface defining an inner chamber, a protrusion extending from the inner side surface into the inner chamber, and loose material disposed within the inner chamber, the method comprising:

before the left foot launches from the ground, accelerating the upwards vertical velocity of each running device such that the loose material in each running device is pushed against the inner bottom surface of the inner chamber, after the left foot has left the ground and before the right foot makes initial contact, accelerating the downwards vertical velocity of each running device such that the loose material in each running device is pushed against the inner top surface of each running device, after the right foot makes initial contact with the ground, decelerating the downwards vertical velocity of each running device such that the loose material in each running device collides with the inner bottom surface of the inner chamber, before the right foot launches from the ground and after decelerating the downwards vertical velocity of each running device, accelerating the upwards vertical velocity of each running device such that the loose material in each running device is pushed against the inner bottom surface of the inner chamber, and after the right foot has left the ground and before the left foot makes initial contact, accelerating the downwards vertical velocity of each running device such that the loose material in each running device is pushed against the inner top surface of each running device.

11. The method of claim 10 further comprising decelerating the downwards vertical velocity of each running device immediately after the left foot makes initial contact with the ground and immediately after the right foot makes initial contact with the ground.

12. The method of claim 11 wherein the collision of the loose material with the inner bottom surface occurs after each foot makes initial contact with the ground and before the foot exerts maximum force on the ground.

13. The method of claim 12 wherein the protrusion and loose material are structured and arranged such that the collision of the loose material with the inner bottom surface increases the maximum force exerted by a foot on the ground.

14. The method of claim 10 wherein the mass of the loose material in the inner chamber is adjustable.

15. A method of using a left running device held in the left hand and right running device held in the right hand, each running device comprising:

a housing having a generally cylindrical outer surface and generally cylindrical inner side surface, an inner top surface, an inner bottom surface, the housing, inner top surface and inner bottom surface defining an inner chamber, a plurality of protrusions extending from the inner side surface into the inner chamber, and pellets disposed within the inner chamber, the method comprising:

before the left foot launches from the ground, accelerating the upwards vertical velocity of each running device such that the pellets in each running device are pushed against the inner bottom surface of the inner chamber, after the left foot has left the ground and before the right foot makes initial contact, accelerating the downwards vertical velocity of each running device such that the pellets in each running device are pushed against the inner top surface of each running device, after the right foot makes initial contact with the ground, decelerating the downwards vertical velocity of each running device such that the pellets in each device collide with the inner bottom surface of the inner chamber, before the right foot launches from the ground and after decelerating the downwards vertical velocity of each running device, accelerating the upwards vertical velocity of each running device such that the pellets in each running device are pushed against the inner bottom surface of the inner chamber, and after the right foot has left the ground and before the left foot makes initial contact, accelerating the downwards vertical velocity of each running device such that the pellets in each running device are pushed against the inner top surface of each running device.

16. The method of claim 15 wherein the housing has an outer surface and a plurality of indentations.

17. The method of claim 16 wherein each indentation on the outer surface corresponds with a protrusion on the inner side surface.

18. The method of claim 15 further comprising decelerating the downwards vertical velocity of each running device immediately after the left foot makes initial contact with the ground and immediately after the right foot makes initial contact with the ground.

19. The method of claim 18 wherein the collision of the pellets with the inner bottom surface occurs after each foot makes initial contact with the ground and before the foot exerts maximum force on the ground.

20. The method of claim 19 wherein the plurality of protrusions and pellets are structured and arranged such that the collision of the pellets with the inner bottom surface increases the maximum force exerted by a foot on the ground.

* * * * *